US011517167B2

(12) United States Patent
Koura et al.

(10) Patent No.: US 11,517,167 B2
(45) Date of Patent: Dec. 6, 2022

(54) AUTONOMOUS CLEANING DEVICE HAVING AN OPTICAL SENSOR

(71) Applicant: MAKITA CORPORATION, Anjo (JP)

(72) Inventors: Kentaro Koura, Anjo (JP); Takuro Konishi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 317 days.

(21) Appl. No.: 16/911,849

(22) Filed: Jun. 25, 2020

(65) Prior Publication Data

US 2020/0405111 A1 Dec. 31, 2020

(30) Foreign Application Priority Data

Jun. 28, 2019 (JP) ..... JP2019-122146

(51) Int. Cl.
*A47L 9/28* (2006.01)
*A47L 9/30* (2006.01)

(52) U.S. Cl.
CPC ..... *A47L 9/2805* (2013.01); *A47L 9/2852* (2013.01); *A47L 9/30* (2013.01); *A47L 2201/04* (2013.01)

(58) Field of Classification Search
CPC ..... A47L 9/2805; A47L 9/2852; A47L 9/30; A47L 2201/04
See application file for complete search history.

(56) References Cited

U.S. PATENT DOCUMENTS 5,109,566 A 5/1992 Kobayashi et al.
6,553,612 B1 4/2003 Dyson et al.
6,581,239 B1 6/2003 Dyson et al.
7,492,124 B2 2/2009 Johnson et al.
7,769,490 B2 8/2010 Abramson et al.
9,532,688 B1 * 1/2017 Ebrahimi Afrouzi ..... A47L 9/2852

(Continued)

FOREIGN PATENT DOCUMENTS

DE 69910252 T2 7/2004
DE 102011004319 A1 8/2012

(Continued)

OTHER PUBLICATIONS

Extended European Search Report from the European Patent Office dated Feb. 19, 2021 in related application No. EP 20 18 2194, including European Search Opinion, European Search Report and examined claims 1-15.

(Continued)

*Primary Examiner* — Marc Carlson
(74) *Attorney, Agent, or Firm* — J-Tek Law PLLC; Jeffrey D. Tekanic; Scott T. Wakeman

(57) ABSTRACT

An autonomous cleaning device (1), such as a robotic vacuum (1), has an optical sensor (50) that includes: a rotary body (51) configured to rotate relative to a main body (2) about a rotational axis (CX); a light-emitting device (61) provided on the rotary body; a light-receiving device (62) provided on the rotary body; a cover (52) disposed upward of the rotary body; and legs (70) disposed around the rotary body and supporting the cover. In a cross section orthogonal to the rotational axis, at least a portion of a surface of each of the legs is inclined with respect to a virtual radial line (RL) extending in the radial direction of the rotational axis.

20 Claims, 25 Drawing Sheets

(56) References Cited

U.S. PATENT DOCUMENTS

| | | | | |
|---|---|---|---|---|
| 2003/0060928 | A1 | 3/2003 | Abramson et al. | |
| 2008/0052867 | A1 | 3/2008 | Park | |
| 2008/0062618 | A1 | 3/2008 | Frank et al. | |
| 2008/0276407 | A1 | 11/2008 | Schnittman et al. | |
| 2008/0281470 | A1 | 11/2008 | Gilbert et al. | |
| 2009/0307865 | A1 | 12/2009 | Williamson et al. | |
| 2010/0088843 | A1 | 4/2010 | Reed et al. | |
| 2012/0011668 | A1 | 1/2012 | Schnittman et al. | |
| 2012/0112689 | A1 | 5/2012 | Sever et al. | |
| 2012/0265343 | A1 | 10/2012 | Gilbert et al. | |
| 2013/0117952 | A1 | 5/2013 | Schnittman et al. | |
| 2015/0214758 | A1* | 7/2015 | Toya | H02J 7/007 320/135 |
| 2015/0366133 | A1* | 12/2015 | Nojiri | A01D 34/902 30/276 |
| 2016/0095487 | A1* | 4/2016 | Koura | A47L 9/1418 429/99 |
| 2017/0296021 | A1* | 10/2017 | Li | A47L 9/2852 |
| 2018/0020893 | A1* | 1/2018 | Lee | A47L 9/2805 701/28 |
| 2019/0357743 | A1* | 11/2019 | Koura | A47L 9/0488 |
| 2020/0383546 | A1* | 12/2020 | Kim | A47L 9/2889 |
| 2020/0405111 | A1* | 12/2020 | Koura | A47L 9/009 |
| 2021/0378474 | A1* | 12/2021 | Li | A47L 5/22 |
| 2022/0061616 | A1* | 3/2022 | Yoon | A47L 11/4061 |

FOREIGN PATENT DOCUMENTS

| | | | |
|---|---|---|---|
| JP | S63311923 | A | 12/1988 |
| JP | H02241423 | A | 9/1990 |
| JP | H0453515 | A | 2/1992 |
| JP | H0588472 | U | 12/1993 |
| JP | 2002532178 | A | 10/2002 |
| JP | 2002360479 | A | 12/2002 |
| JP | 2002360480 | A | 12/2002 |
| JP | 2006043302 | A | 2/2006 |
| JP | 2008155041 | A | 7/2008 |
| JP | 2009229458 | A | 10/2009 |
| JP | 2013239259 | A | 11/2013 |
| JP | 2014030484 | A | 2/2014 |
| JP | 2014036750 | A | 2/2014 |
| JP | 2014083241 | A | 5/2014 |
| JP | 2014111190 | A | 6/2014 |
| JP | 2014147904 | A | 8/2014 |
| JP | 2014180501 | A | 9/2014 |
| JP | 2018007849 | A | 1/2018 |
| WO | 0036962 | A1 | 6/2000 |
| WO | 0038255 | A1 | 6/2000 |
| WO | 2014021116 | A1 | 2/2014 |
| WO | 2014119160 | A1 | 8/2014 |
| WO | 2014119732 | A1 | 8/2014 |
| WO | 2014155904 | A1 | 10/2014 |

OTHER PUBLICATIONS

Robot® Roomba® 400 Series Owner's manual having created date of Mar. 29, 2010.

Robot® Roomba® 500 Series Owner's manual having created date of Mar. 22, 2010.

Robot® Roomba® 600 Series Owner's manual having created date of Sep. 20, 2012.

Robot® Roomba® 700 Series Owner's manual having created date of Dec. 17, 2012.

Robot® Roomba® 800 Series Owner's manual having created date of Mar. 7, 2014.

Müheloses Gärtnem (easy gardening), Bosch-Gartengeräte 2013, Robert Bosch GmbH Power Tools, D-70745 Leinfelden Echterdingen (p. 69).

* cited by examiner

AUTONOMOUS CLEANING DEVICE HAVING AN OPTICAL SENSOR

CROSS-REFERENCE

The present application claims priority to Japanese patent application serial number 2019-122146 filed on Jun. 28, 2019, the contents of which are incorporated fully herein by reference.

TECHNICAL FIELD

The present invention generally relates to an autonomous cleaning device, such as a robotic vacuum, having an optical sensor.

BACKGROUND ART

U.S. Patent Publication No. 2017/0296021 discloses a robotic vacuum (autonomous cleaning device) that collects or suctions dust, debris, etc. while traveling autonomously across a surface-to-be-cleaned. The robotic vacuum comprises an optical sensor (sensing module), which includes a rotating laser distance sensor (LDS) that detects surrounding objects for navigation, e.g., according to a simultaneous localization and mapping ("SLAM") algorithm.

SUMMARY OF THE INVENTION

The known optical sensor of U.S. Patent Publication No. 2017/0296021 comprises: a base (rotary body), which rotates about a rotational axis during operation of the robotic vacuum; a light emitting unit provided on the rotatable base; a light receiving unit provided on the rotatable base; a protection cover disposed upward of the rotatable base; and support columns (legs) disposed around the rotatable base at intervals and supporting the protection cover. Detection light (e.g., infrared or visible light) emitted from the (rotating) light emitting unit passes through spaces between adjacent support columns and is radiated towards surrounding objects. Detection light reflected by one or more objects in the surrounding area passes (returns) through the spaces between adjacent support columns and enters (impinges upon) the light receiving unit. However, if the support columns are too thick in the design of U.S. Patent Publication No. 2017/0296021, then the passage of the detection (emitted) light and/or the reflected light may be so obstructed or blocked by the support columns that the detection accuracy of the optical sensor is reduced. On the other hand, if the support columns are made too thin (in order to avoid or minimize this detection accuracy reduction problem), then the strength of the support columns might become insufficient, thereby leading to the risk that the support columns will deform or break in case the protection cover contacts a surrounding object and/or a weight (pressure) is placed onto the protection cover from above and/or the side.

It is therefore one non-limiting object of the present teachings to disclose one or more techniques for avoiding or reducing a decrease in detection accuracy of a rotating optical sensor of an autonomous cleaning device while ensuring sufficient strength (robustness) of legs (support columns) that support a cover for the rotating optical sensor.

In one non-limiting aspect of the present teachings, an autonomous cleaning device includes an optical sensor that comprises: a rotary body adapted/configured to rotate about a rotational axis, e.g., relative to a substrate or base such as a support member or housing; a light-emitting device provided on the rotary body; a light-receiving device provided on the rotary body; a cover disposed upward of the rotary body; and legs (support columns) disposed at intervals around the rotary body and supporting the cover, e.g., relative to the substrate or base such as the support member or housing. In a cross section orthogonal to the rotational axis, at least a portion of a surface of each of the legs is inclined (slanted, sloped, oblique) with respect to a virtual radial line extending in a radial direction of the rotational axis. In other words, each of the legs may have at least one surface portion, preferably at least one flat surface portion, more preferably two discrete flat surface portions that form an angle with each other or are parallel to each other, that is (are) inclined or oblique with respect to a radial line that intersects and is perpendicular to the rotational axis, such that the surface portion forms an angle, other than a right angle, with the radial line.

In embodiments according to the above-mentioned aspect of the present teachings, it is possible to reduce or minimize a decrease in detection accuracy of the optical sensor of the autonomous cleaning device while providing robust legs for supporting the cover.

Further objects, aspects, embodiments and advantages of the present teachings will become apparent upon reading the following detailed description together with the appended drawings and claims.

DETAILED DESCRIPTION OF THE INVENTION

First Embodiment

Robotic Vacuum

Figure 1:
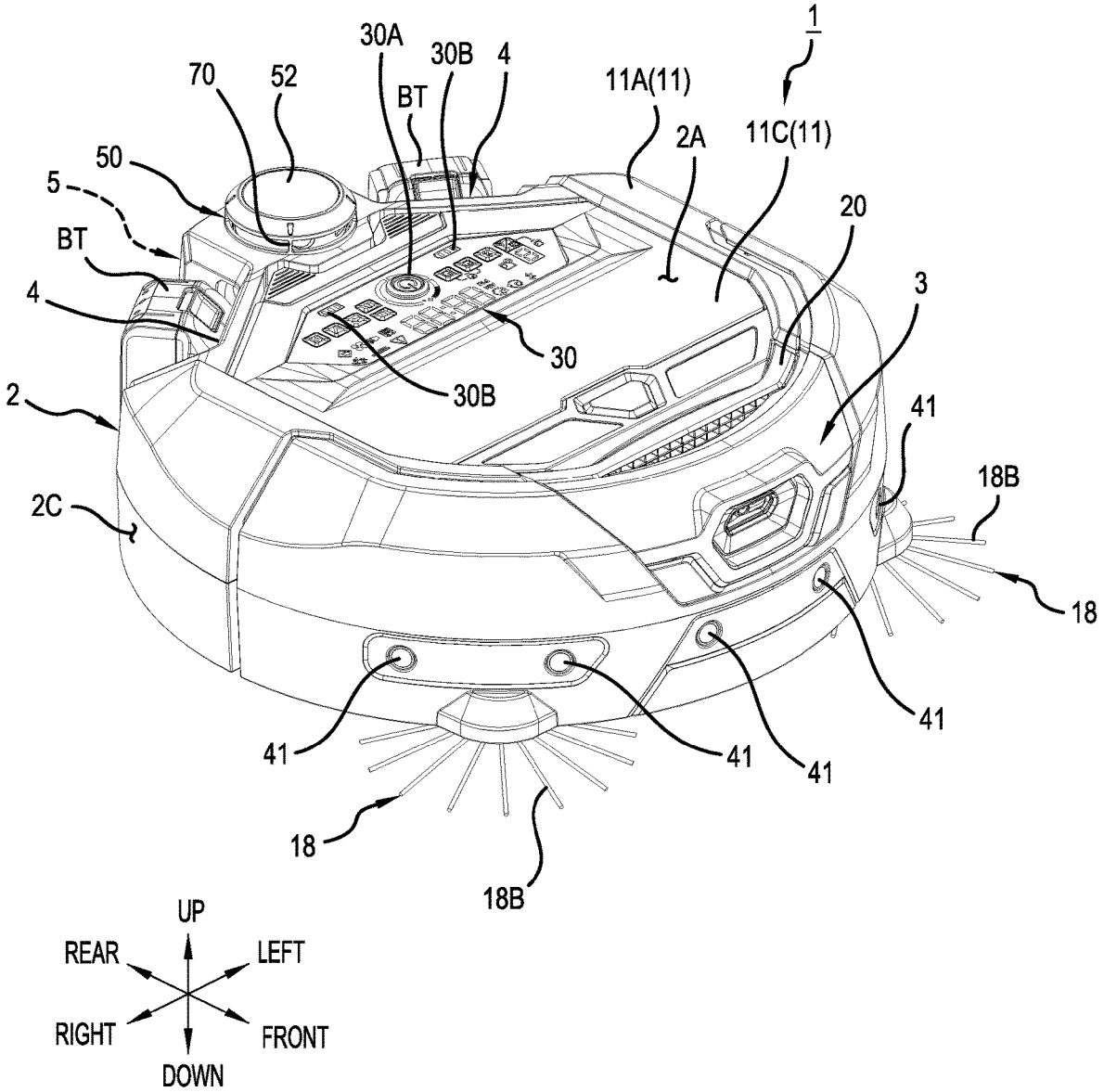
FIG. 1 is an oblique view of a robotic vacuum (autonomous cleaning device) according to a first embodiment of the present teachings.
Figure 2:
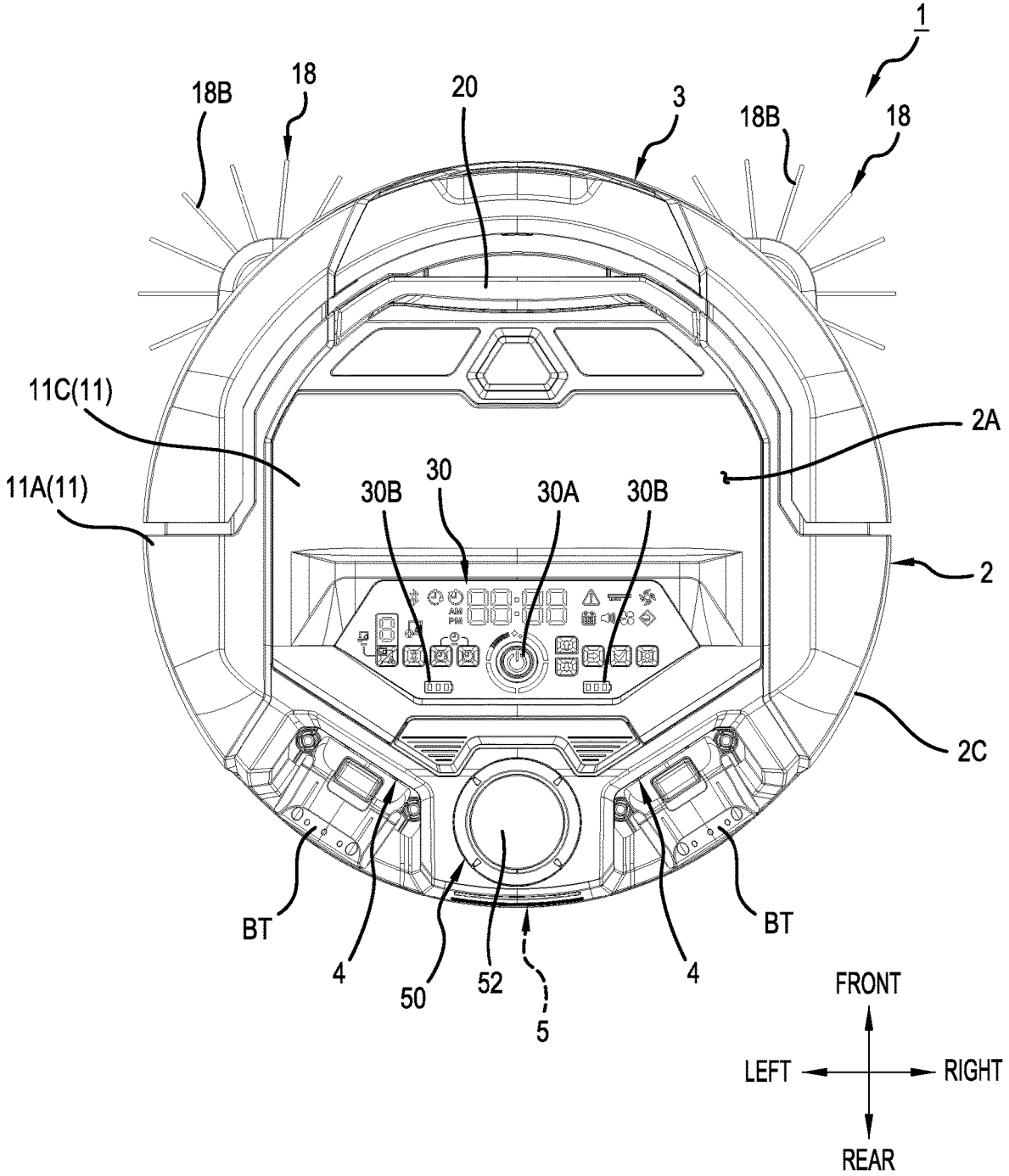
FIG. 2 is a top view of the robotic vacuum according to the first embodiment.

As was mentioned in the preceding section, FIGS. 1-6 show various views of a robotic vacuum (autonomous cleaning device) 1 according to a first exemplary, non-limiting embodiment of the present teachings.

In the present embodiment and the further embodiments explained below, the positional relationships among the parts are explained using the terms "left," "right," "front," "rear," "up," and "down." These terms indicate relative position or direction, using the center of the robotic vacuum 1 as a reference.

The robotic vacuum 1 collects dust, dirt, debris, etc. while traveling autonomously on a surface-to-be-cleaned FL. As shown in FIGS. 1-6, the robotic vacuum 1 comprises a main body 2, a bumper 3, two battery-mounting parts 4, a fan unit 5, a dust box 6, two castors 7, a roller 8, a travelling apparatus 12, a main brush 16, a main-brush motor 17, two side brushes 18, two side-brush motors 19, a handle 20, a user interface (interface apparatus) 30, obstacle sensors 41, a cliff (drop-down prevention) sensor 42, boundary (element) sensors 43, an optical sensor 50, and a controller 100.

The main body 2 has an upper surface 2A; a bottom surface 2B, which opposes the surface-to-be-cleaned FL; and a side surface 2C, which connects a circumferential-edge part of the upper surface 2A and a circumferential-edge part of the bottom surface 2B. The outer shape of the main body 2 has a substantially circular shape within a plane that is parallel to the upper surface 2A.

The main body 2 comprises a housing 11, which has an interior space. The housing 11 comprises: an upper housing 11A; a lower housing 11B, which is disposed downward of and is connected to the upper housing 11A; a cover plate 11C, which is mounted, such that it can be opened and closed, on the upper housing 11A; and a bottom plate 11D, which is mounted on the lower housing 11B. The upper surface 2A spans the upper housing 11A and the cover plate 11C. The bottom surface 2B spans the lower housing 11B and the bottom plate 11D.

The main body 2 has a suction port 15 provided in the bottom plate 11D. The suction port 15 is provided in (at) a front portion of the bottom surface 2B and opposes (faces) the surface-to-be-cleaned FL. The suction port 15 suctions in dust, debris, etc. from the surface-to-be-cleaned FL.

The bumper 3 opposes at least a portion of the side surface 2C and is movable relative to the side surface 2C. More specifically, the bumper 3 is supported in a movable manner by the main body 2 and opposes a front portion of the side surface 2C. When the bumper 3 bumps into an object in the vicinity of the robotic vacuum 1, the bumper 3 moves relative to the main body 2 and thereby cushions the impact that acts on the main body 2.

The two battery-mounting parts 4 respectively support two batteries (battery packs, battery cartridges) BT. That is, the batteries BT are respectively mounted on the battery-mounting parts 4. Each battery-mounting part 4 is provided on at least a portion of an outer surface of the main body 2, although it also possible to provide the battery-mounting part(s) such that it is (they are) disposed within the main body 2 and covered by a hinged cover. In the present embodiment, two recesses are provided on a rear portion of the upper housing 11A. The battery-mounting parts 4 are provided (defined) on inner sides of the recesses of the upper housing 11A.

When one or two of the batteries BT is (are) mounted on the battery-mounting parts 4, the battery BT (or batteries BT) supplies (supply) electric power to the electrical components within the robotic vacuum 1. The batteries BT are preferably general-purpose power tool batteries (battery packs, battery cartridges) that can be used as the power supply of various electrical components, such as other types of power tools (e.g., driver-drills, impact drivers, circular saws, etc.) and/or outdoor power equipment (e.g., blowers, mowers, string trimmers, etc.). The batteries BT also may be adapted/configured such that they can be used as the power supply of a vacuum (dust collector) other than the robotic vacuum 1 according to the present embodiment, such as an upright vacuum and/or a hand-held vacuum. The batteries BT may be lithium-ion batteries or another type of battery chemistry and are preferably rechargeable batteries. The battery-mounting parts 4 preferably each have a structure that is equivalent to the battery-mounting part of a power tool, so that power tool battery packs (cartridges) may be used with the robotic vacuum 1 in an interchangeable manner.

Figure 5:
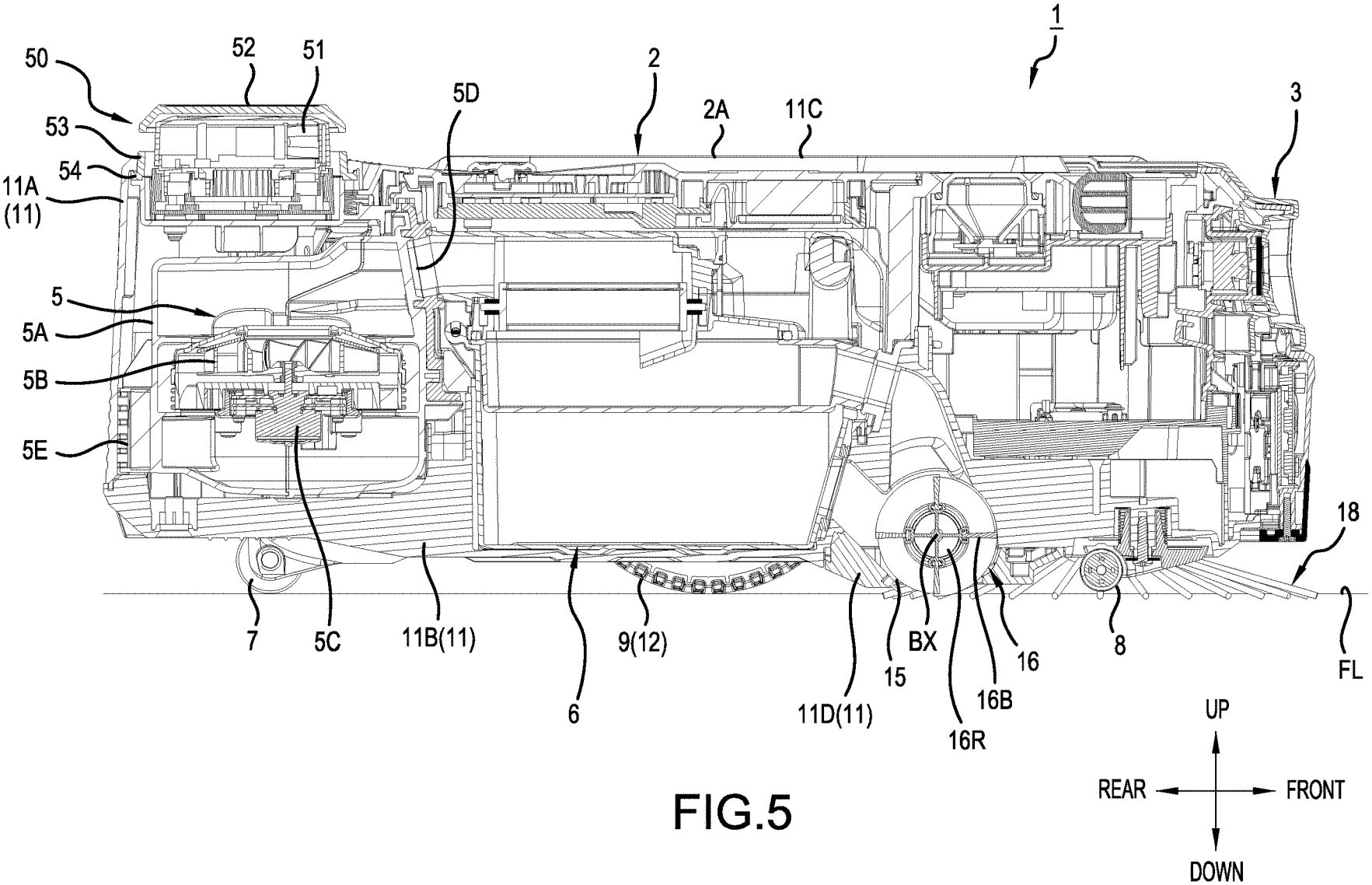
FIG. 5 is a cross-sectional view of the robotic vacuum according to the first embodiment.
Figure 6:
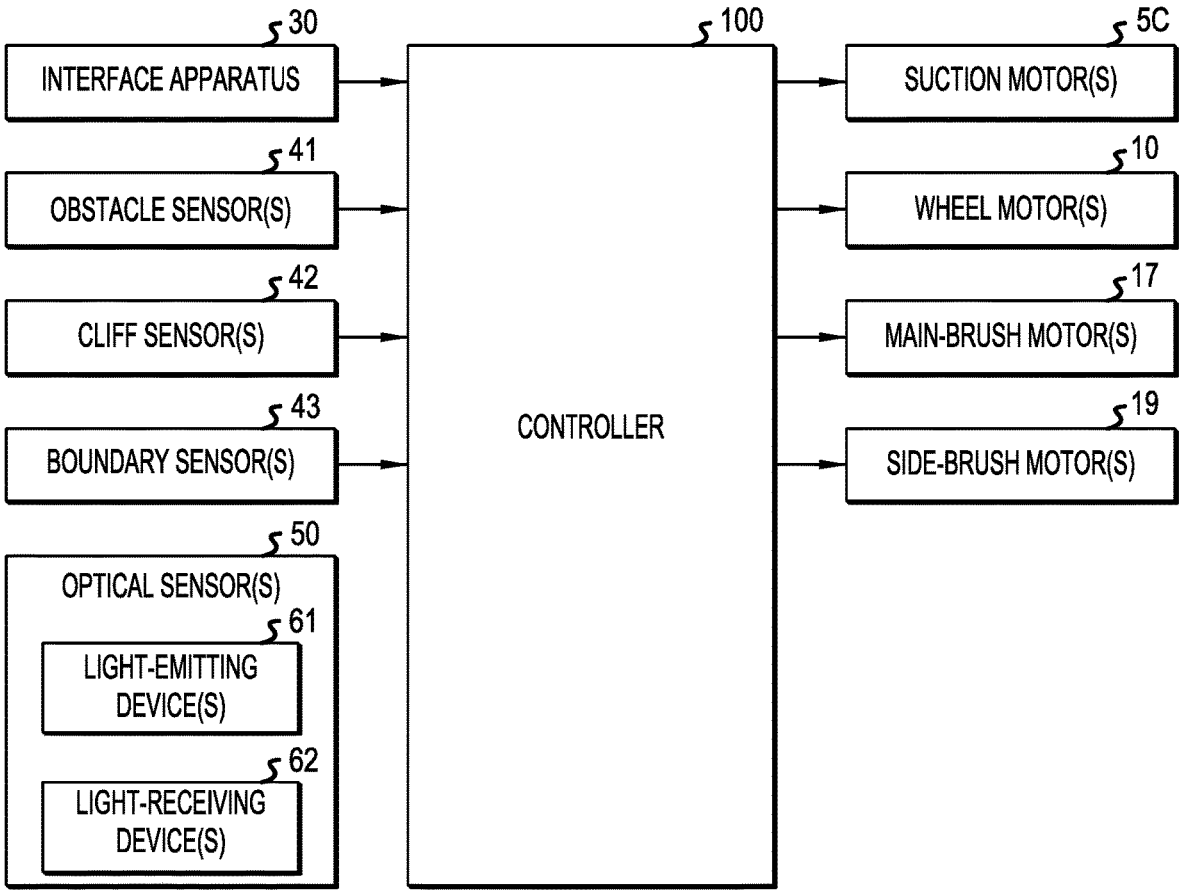
FIG. 6 is a block diagram (circuit diagram) of the robotic vacuum according to the first embodiment.

The fan unit 5 is disposed in the interior space of the housing 11. The fan unit 5 generates a suction force, which is for suctioning dust, debris, etc., at (in) the suction port 15. The fan unit 5 generates the suction force at (in) the suction port 15 via the dust box 6. As shown in FIG. 5, the fan unit 5 comprises: a casing 5A, which is disposed in the interior space of the housing 11; a suction fan 5B, which is provided on an inner side of the casing 5A; and a suction motor 5C, which generates power that rotates the suction fan 5B. The casing 5A has: an air-suction port 5D, which is connected to the dust box 6; and an air-exhaust port 5E.

The dust box 6 is disposed in the interior space of the housing 11. The dust box 6 collects and stores the dust, debris, etc. that was suctioned in through the suction port 15.

The cover plate 11C is mounted such that it is capable of opening and closing an opening provided in the upper housing 11A. A user of the robotic vacuum 1 can remove the dust box 6 from the interior space of the housing 11, and can house (insert) the dust box 6 in the interior space of the housing 11, through the opening in the upper housing 11A.

The two castors 7 and the roller 8 movably support the main body 2. The castors 7 and the roller 8 are rotatably supported by the main body 2. The two castors 7 are provided on a rear portion of the bottom surface 2B. One of the castors 7 is provided on a left portion of the main body 2. The other castor 7 is provided on a right portion of the main body 2. The single roller 8 is provided on the front portion of the bottom surface 2B.

The travelling apparatus 12 causes the main body 2 to move at least one of forward and rearward. The travelling apparatus 12 comprises two wheels 9 and two wheel motors 10.

The wheels 9 movably support the main body 2. The wheels 9 rotate about a rotational axis AX, which extends in the left-right direction. At least a portion of each wheel 9 protrudes downward beyond the bottom surface 2B. When the wheels 9 are placed on the surface-to-be-cleaned FL, the bottom surface 2B of the main body 2 opposes the surface-to-be-cleaned FL across a gap. One of the wheels 9 is provided on the left portion of the main body 2. The other wheel 9 is provided on the right portion of the main body 2.

The two wheel motors 10 generate power that respectively rotates the two wheels 9 using electric power supplied from the batteries BT. The wheel motors 10 are disposed in the interior space of the housing 11. One of the wheel motors 10 generates power that rotates the wheel 9 provided on the left portion of the main body 2. The other wheel motor 10 generates power that rotates the wheel 9 provided on the right portion of the main body 2. The robotic vacuum 1 travels autonomously by rotating the wheels 9.

The main brush 16 is disposed in the suction port 15 and opposes the surface-to-be-cleaned FL. The main brush 16 rotates about a rotational axis BX extending in the left-right direction. The main brush 16 comprises a rod 16R, which extends in the left-right direction, and a plurality of brushes 16B connected to an outer surface of the rod 16R. A left-end portion and a right-end portion of the rod 16R are each rotatably supported by the main body 2. The rod 16R is supported by the main body 2 such that at least a portion of each brush 16B protrudes downward beyond the bottom surface 2B. When the wheels 9 are placed on the surface-to-be-cleaned FL, at least a portion of the main brush 16 contacts the surface-to-be-cleaned FL.

The main-brush motor 17 generates power that rotates the main brush 16 using electric power supplied from the batteries BT. The main-brush motor 17 is disposed in the interior space of the housing 11. The main brush 16 is rotatably driven by the main-brush motor 17. When the main brush 16 rotates, dust, debris, etc. present on the surface-to-be-cleaned FL is swept up and suctioned through the suction port 15.

The two side brushes 18 are disposed on the front portion of the bottom surface 2B and oppose the surface-to-be-cleaned FL. At least a portion of each side brush 18 is disposed forward of the main body 2. One of the side brushes 18 is provided leftward of the suction port 15. The other side brush 18 is provided rightward of the suction port 15. The side brushes 18 each comprise a plurality of brushes 18B connected to a disk 18D in a radially extending manner. The two disks 18D are rotatably supported by the main body 2 such that at least a portion of each corresponding brush 18B protrudes outward of the side surface 2C. When the wheels 9 are placed on the surface-to-be-cleaned FL, at least a portion of each side brush 18 contacts the surface-to-be-cleaned FL.

The two side-brush motors 19 generate power that respectively rotates the two side brushes 18 using electric power supplied from the batteries BT. The side-brush motors 19 are disposed in the interior space of the housing 11. The side brushes 18 are rotatably driven by the side-brush motors 19. Owing to the rotation of the side brushes 18, dust, debris, etc. present around the main body 2 on the surface-to-be-cleaned FL is moved towards the suction port 15.

The handle 20 is provided on a front portion of the upper housing 11A. First and second ends of the handle 20 are pivotably coupled to the upper housing 11A. The user of the robotic vacuum 1 can lift up the robotic vacuum 1 by holding the handle 20 and can thereby carry the robotic vacuum 1.

The user interface 30 is disposed on a rear portion of the cover plate 11C. The user interface 30 comprises a plurality of manipulatable parts (e.g., press buttons or a touchscreen display), which are (is) manipulated (pressed) by the user of the robotic vacuum 1 to input manual commands, and one or more display parts. A power-supply button 30A is an illustrative example of a manipulatable part of the user interface 30. Remaining-battery-charge display parts 30B of the batteries BT are illustrative examples of display parts of the user interface 30.

The obstacle sensors 41 detect, in a non-contacting manner, objects present at least partly in the surroundings of the robotic vacuum 1. Each obstacle sensor 41 comprises an ultrasonic sensor (ultrasonic sensor) that detects objects by emitting ultrasonic waves. More specifically, multiple obstacle sensors 41 are provided in a spaced apart manner on the side surface 2C of the main body 2. Based on the detection data output by the obstacle sensors 41, the controller 100 controls the wheel motors 10 so as to change the direction of advance of the travelling apparatus 12 or stop the travel of the travelling apparatus 12, e.g., such that the main body 2 and the bumper 3 do not make contact with the object. It is noted that the controller 100 also may be adapted/configured to change the direction of advance or stop the travel of the travelling apparatus 12 after the main body 2 or the bumper 3 have made contact with an object.

Figure 3:
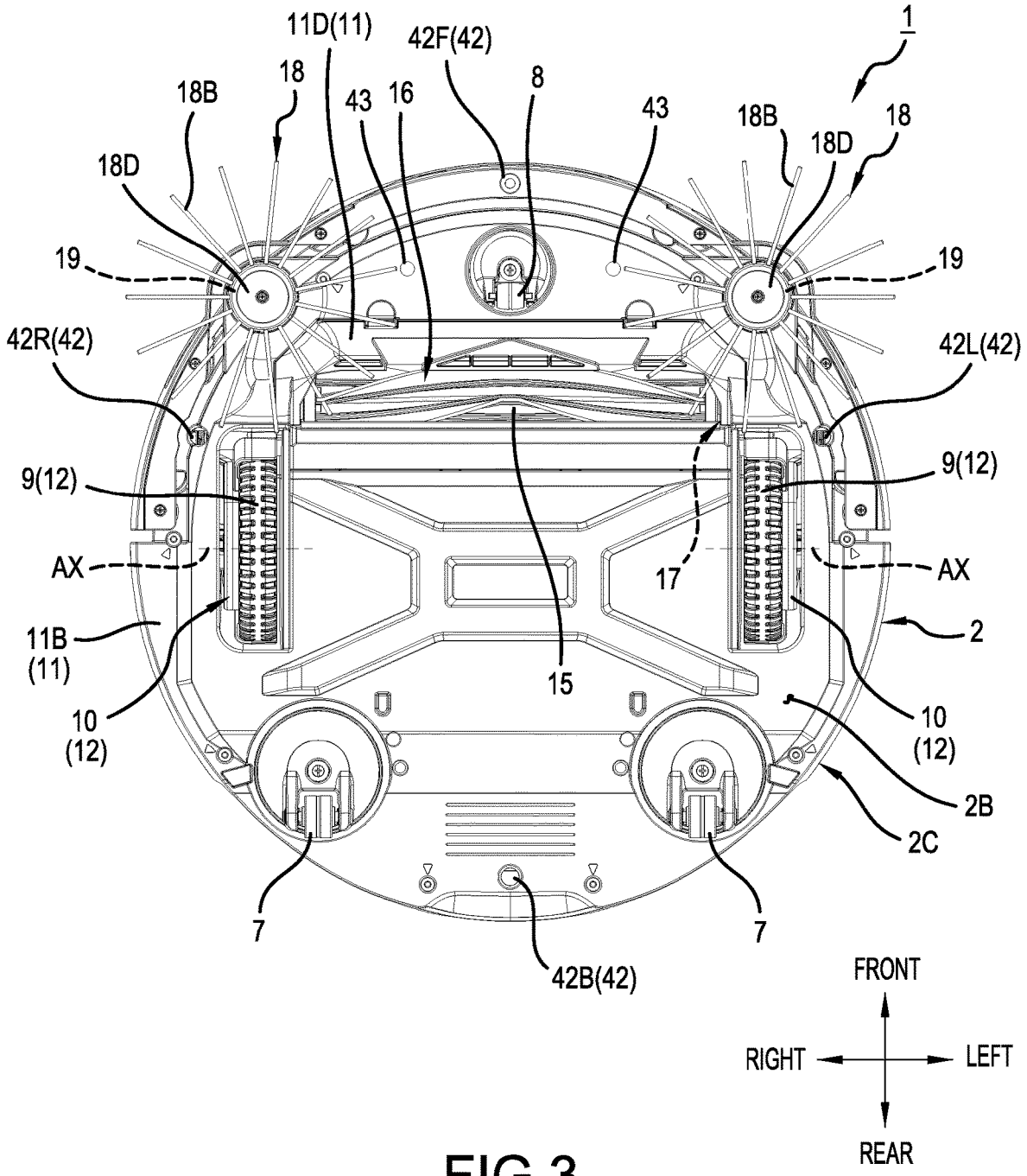
FIG. 3 is a bottom view of the robotic vacuum according to the first embodiment.
Figure 4:
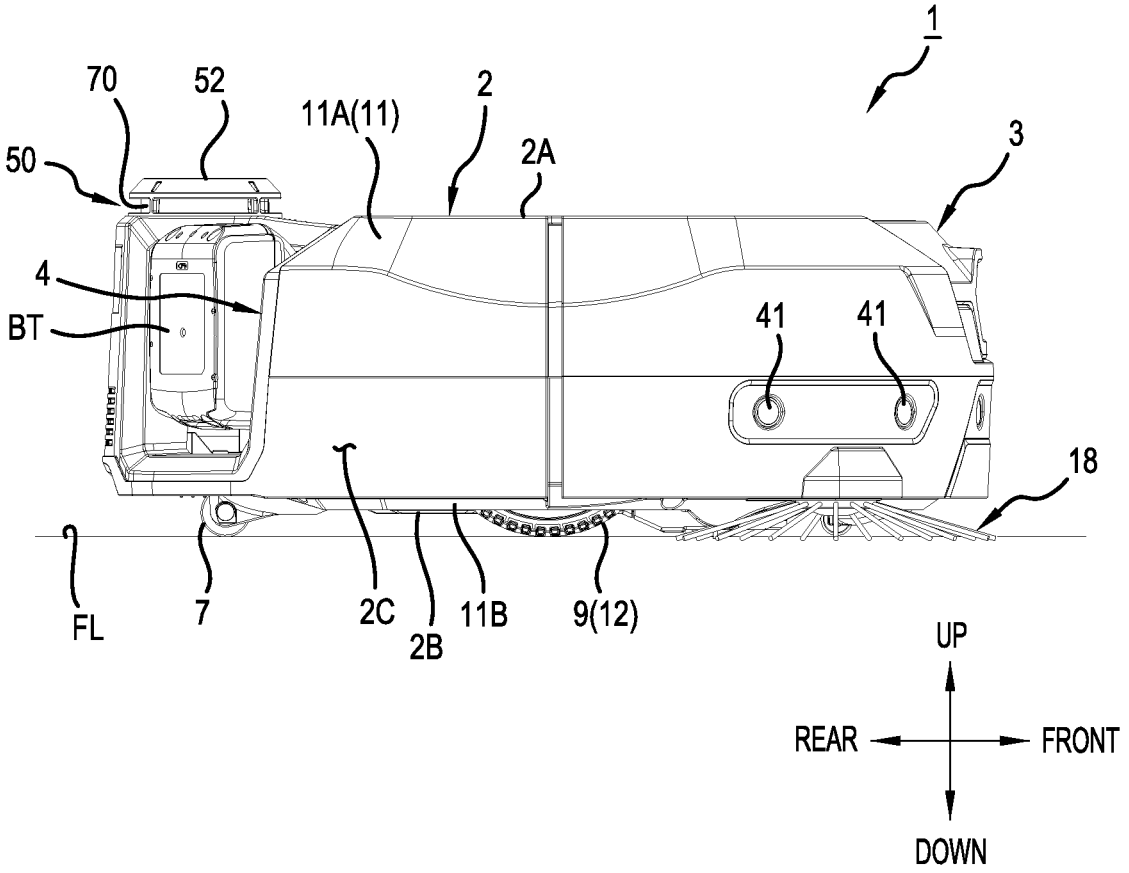
FIG. 4 is a side view of the robotic vacuum according to the first embodiment.

The cliff sensor 42 detects, in a non-contacting manner, whether the surface-to-be-cleaned FL is located within a stipulated distance range from the bottom surface 2B. More specifically, the cliff sensor 42 comprises at least one optical sensor that detects objects (here, a floor) by emitting light and by processing light that is reflected from the object (floor). The cliff sensor 42 is disposed on the bottom surface 2B. As shown in FIG. 3, the cliff sensor 42 may preferably comprise: a first cliff sensor 42F on the front portion of the bottom surface 2B; a second cliff sensor 42B provided on the rear portion of the bottom surface 2B; a third cliff sensor 42L provided on a left portion of the bottom surface 2B; and a fourth cliff sensor 42R provided on a right portion of the bottom surface 2B. The cliff sensor(s) 42 detect(s) the distance to the surface-to-be-cleaned FL by emitting detection light downward. If, based on the detection data output by the cliff sensor 42, the controller 100 determines that the surface-to-be-cleaned FL is not present within the stipulated distance range from the bottom surface 2B, then the controller 100 controls the wheel motors 10 to stop the travel of the travelling apparatus 12 and/or change the direction of travel.

The boundary sensors 43 detect, in a non-contacting manner, demarcation elements provided on the surface-to-be-cleaned FL. Each boundary sensor 43 comprises an optical sensor that emits detection light to detect such demarcation elements. The boundary sensors 43 are disposed on the bottom surface 2B. As shown in FIG. 3, multiple boundary sensors 43 are disposed in a spaced apart manner on the front portion of the bottom surface 2B. The user may dispose demarcation elements at any location(s) on the surface-to-be-cleaned FL that should serve as a boundary for cleaning work performed by the robotic vacuum 1. For example, reflective tape that includes a reflective material is an illustrative example of a demarcation element according to the present teachings. The boundary sensors 43 detect the demarcation element(s) by emitting detection light downward. Based on the detection data output by the boundary sensors 43, the controller 100 controls the wheel motors 10 so that the robotic vacuum 1 does not travel beyond (across) the demarcation element(s).

Optical Sensor

The optical sensor 50 emits detection light to detect, in a non-contacting manner, objects in the surroundings of the main body 2. In the present embodiment, the optical sensor 50 comprises a laser sensor (light detection and ranging; LIDAR) that detects objects by emitting laser light, e.g. in the infrared wavelength range, in the visible wavelength range and/or in the ultraviolet wavelength range. Preferably, the optical sensor 50 may comprise a unit having an infrared-light emitter (e.g., an infrared laser diode) and an infrared-light sensor (e.g., a photodiode) that enables objects to be detected based upon detection of reflected infrared light or may comprise a radar sensor (radio detection and ranging; RADAR) that detects objects by emitting radio waves. The optical sensor 50 is disposed on the rear portion of the upper housing 11A in the present embodiment, but it may be disposed anywhere on the upper surface of the upper housing 11A so that electromagnetic radiation (e.g., light, radio waves, etc.) may be emitted 360° around the robotic vacuum 1.

Figure 7:
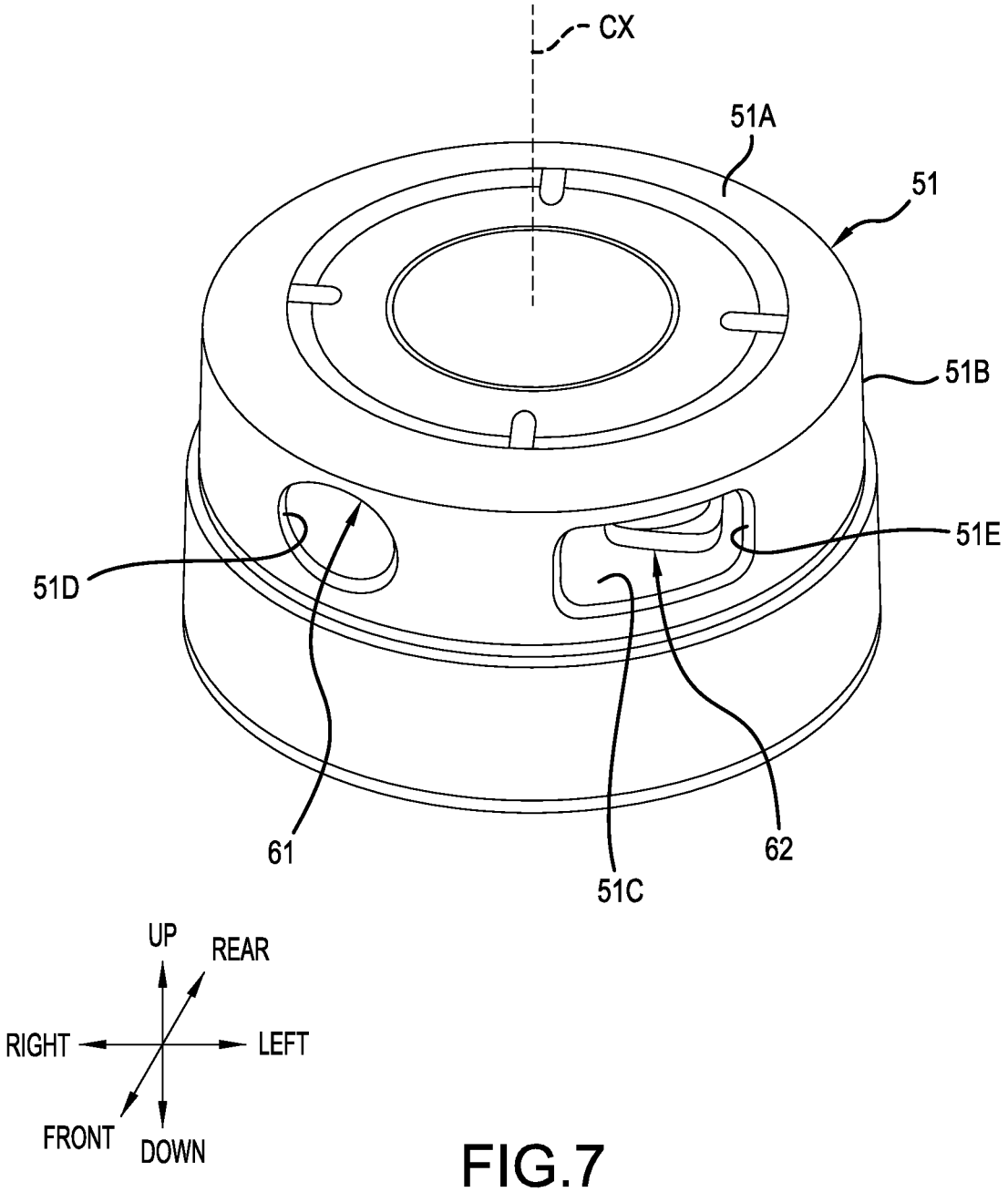
FIG. 7 is an oblique view of a portion of an optical sensor according to the first embodiment.
Figure 8:
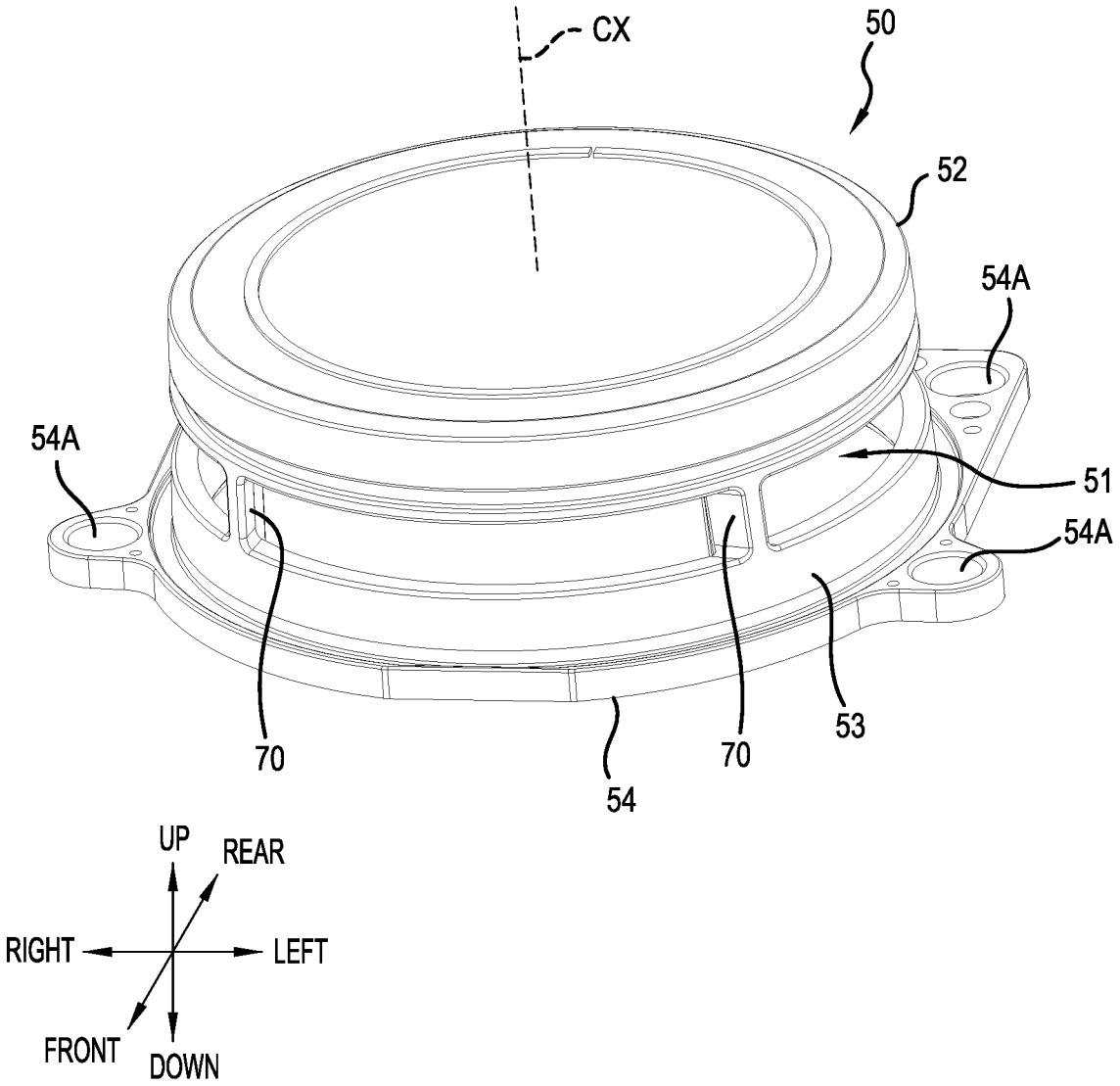
FIG. 8 is an oblique view of another portion of the optical sensor according to the first embodiment.
Figure 9:
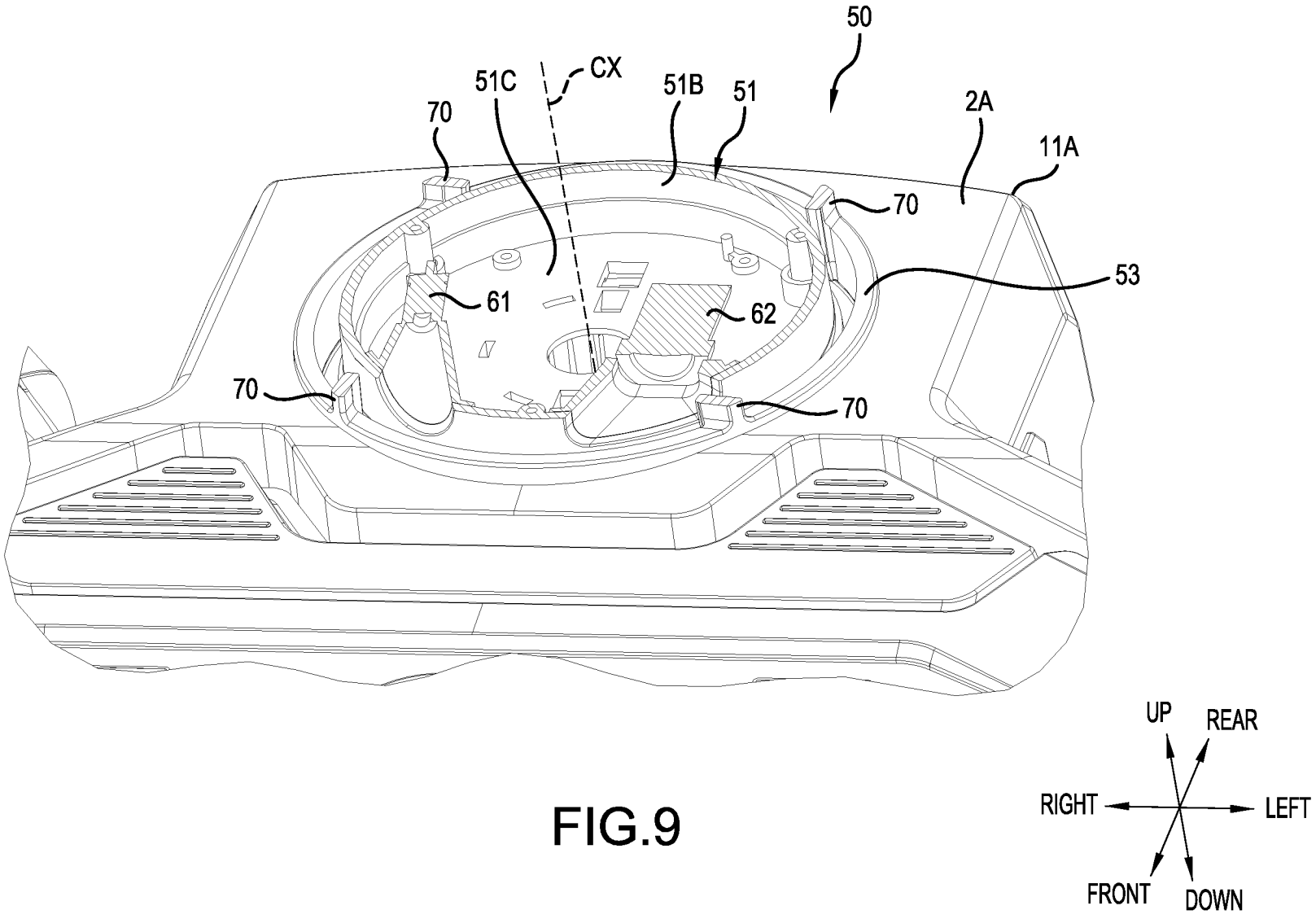
FIG. 9 is a partial, broken, oblique view of the optical sensor according to the first embodiment.

FIG. 7 is an oblique view of a portion of the optical sensor 50 according to the present embodiment. FIG. 8 is an oblique view of another portion of the optical sensor 50 according to the present embodiment. FIG. 9 is a partial, broken oblique view of the optical sensor 50 according to the present embodiment. As shown in FIGS. 5 and 7-9, the optical sensor 50 comprises: a rotary body 51, which rotates about a rotational axis CX; a light-emitting device 61, which is provided on (affixed to) the rotary body 51; a light-receiving device (light sensing device or light sensor) 62, which is provided on (affixed to) the rotary body 51; a cover 52, which is disposed upward of the rotary body 51; legs (support columns) 70, which are disposed around the rotary body 51 and support the cover 52; a support member 53, which supports the legs 70; and a coupling member 54, which supports the support member 53 and/or enables the support member 53 to be coupled/connected to the main body 2. Although the term "light" is utilized herein, it is understood that any embodiments that emit electromagnetic radiation are intended to be disclosed and covered by the term "light", regardless of whether the "light" (i.e. electromagnetic radiation) is in the visible (400-700 nm) range or not.

As shown in FIG. 7, the rotary body 51 comprises a top-plate part 51A, a side-plate part 51B, and a holding-plate part 51C. The interior space of the rotary body 51 is defined by the top-plate part 51A, the side-plate part 51B, and the holding-plate part 51C. The light-emitting device 61 and the light-receiving device 62 are disposed in the interior space of the rotary body 51. The top-plate part 51A is disposed upward of the light-emitting device 61 and the light-receiving device 62. The side-plate part 51B is disposed around the light-emitting device 61 and the light-receiving device 62. The side-plate part 51B has a first opening 51D, through which the detection light emitted from the light-emitting device 61 passes, and a second opening 51E, through which the detection light that enters the light-receiving device 62 passes. The holding-plate part 51C is disposed downward of the top-plate part 51A and the side-plate part 51B. The light-emitting device 61 and the light-receiving device 62 are held by the holding-plate part 51C.

The rotary body 51 holds the light-emitting device 61 and the light-receiving device 62 such that rotation of the rotary body 51 causes the light-emitting device 61 and the light-receiving device 62 to also rotate therewith. Such rotation may be utilized, e.g., to perform simultaneous localization and mapping (SLAM) to generate navigation data for the robotic vacuum 1. Rotational axis CX of the rotary body 51 is orthogonal to the upper surface 2A of the main body 2 and extends in the up-down (vertical) direction, i.e. perpendicular to the surface-to-be-cleaned FL. In a cross section orthogonal to rotational axis CX, the outer shape of the rotary body 51 is circular.

The cover 52 protects the rotary body 51 from above and the cover 52 is stationary relative to the main body 2, such that the rotary body 51 rotates relative to the cover 52. In a cross section orthogonal to rotational axis CX, the outer shape of the cover 52 is circular. The diameter of the cover 52 is larger than the diameter of the rotary body 51.

The legs 70 are disposed (extend) downward of the cover 52. The legs 70, i.e. two, three or more of the legs 70, are provided in a spaced apart manner around the rotary body 51. In the present embodiment, four of the legs 70 are provided around the rotary body 51.

The support member 53 is disposed downward of the legs 70. At least a portion of the support member 53 is disposed around the rotary body 51. In a cross section orthogonal to rotational axis CX, the outer shape of the support member 53 is circular. The diameter of the support member 53 is larger than the diameter of the rotary body 51.

The coupling member 54 is disposed downward of the support member 53. In the radial direction of rotational axis CX, at least a portion of the coupling member 54 protrudes outward of the outer surface of the support member 53.

The coupling member 54 is coupled (attached) to the rear portion of the upper housing 11A. The coupling member 54 has openings 54A, in which bolts are respectively disposed. Therefore, the coupling member 54 and at least a portion of the upper housing 11A are fixed to one another by the bolts.

The cover 52, the legs 70, the support member 53, and the coupling member 54 are one body, i.e. they are integrally formed without a seam therebetween, e.g., by a unitary polymer material. An upper-end part of each leg 70 is connected to the circumferential-edge part of the cover 52. A lower-end part of each leg 70 is connected to the circumferential-edge part of the support member 53. The cover 52, the legs 70, the support member 53, and the coupling member 54 are each made of synthetic polymer (resin).

It is noted that the cover 52 and the legs 70 may be separate or discrete members that are joined together with a seam therebetween. The legs 70 and the support member 53 may be separate or discrete members that are joined together with a seam therebetween. The support member 53 and the coupling member 54 may be separate or discrete members that are joined together with a seam therebetween. In addition, the material of the cover 52 may differ from the material of the legs 70. For example, the cover 52 may be made of synthetic polymer (resin), and the legs 70 may be made of metal, or vice versa.

It is noted that the support member 53 and the coupling member 54 may be omitted. In such an embodiment, the lower-end part of each leg 70 may be connected to the upper housing 11A and the rotary body 51 may be rotatably supported by a portion of the upper housing 11A.

Figure 10:
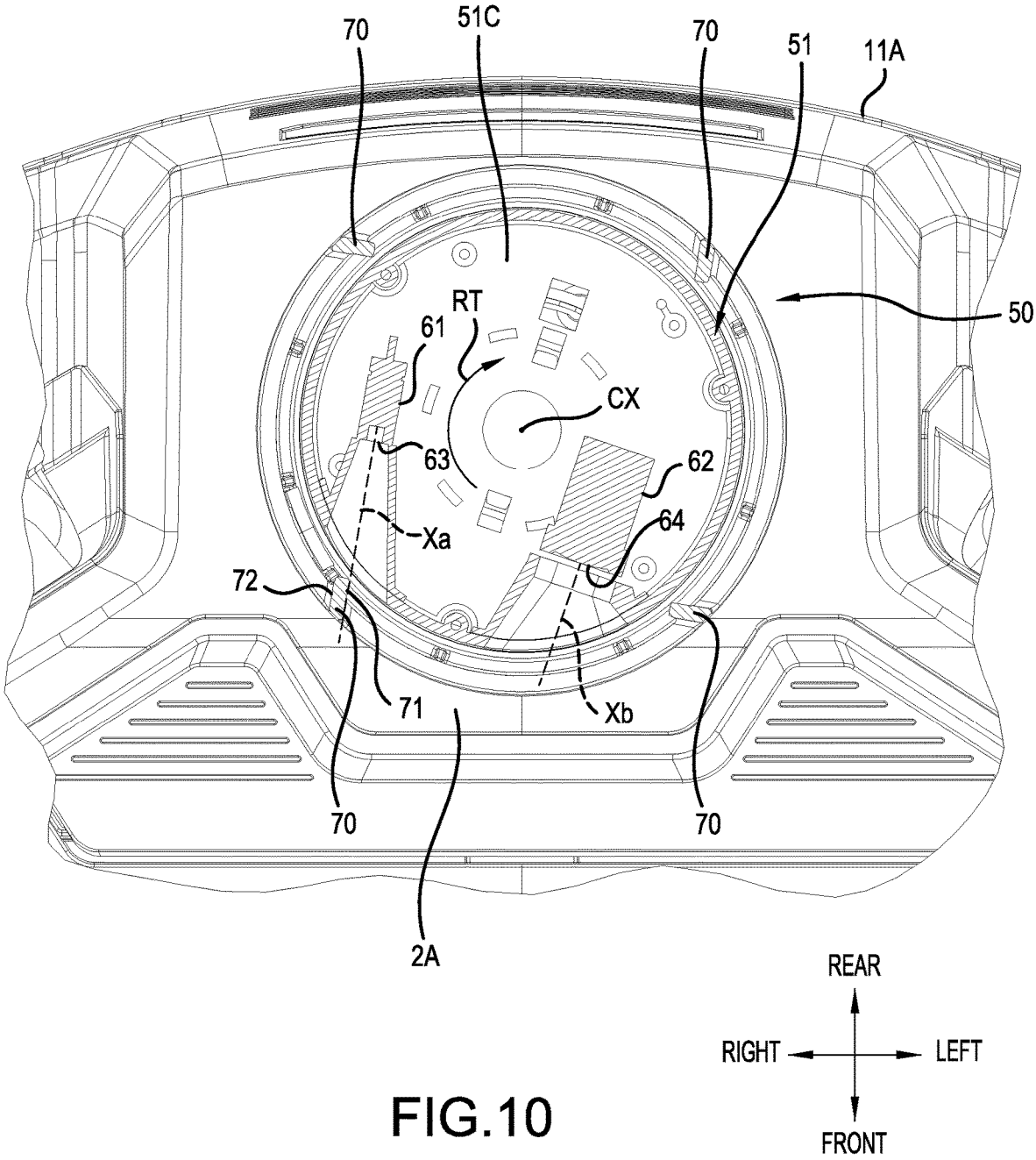
FIG. 10 is a cross-sectional view of a rotary body and legs according to the first embodiment.

FIG. 10 is a cross-sectional view of the rotary body 51 and the legs 70 according to the present (first) embodiment. FIG. 10 shows a cross section orthogonal to rotational axis CX. As shown in FIG. 9 and FIG. 10, the light-emitting device 61 and the light-receiving device 62 are each provided on the rotary body 51.

The light-emitting device 61 (e.g., one or more light-emitting diodes) emits detection light (electromagnetic radiation in any suitable wavelength(s)) for detecting objects. The light-emitting device 61 preferably emits laser light as the detection light. The light-emitting device 61 has a light-emitting surface 63, from which the detection light is emitted. As the rotary body 51 rotates, the detection light emitted from the light-emitting surface 63 passes through spaces or openings, which are defined between (by) adjacent legs 70, and is radiated towards objects in the surroundings of the main body 2.

The light-receiving device (light sensor, e.g., one or more photodiodes) 62 receives at least a portion of the detection light emitted from the light-emitting device 61 that has been reflected by one or more objects in the surroundings of the main body 2. The light-receiving device 62 has a light-receiving surface 64, on which the detection light impinges. More specifically, at least a portion of the detection light, which is emitted from the light-emitting device 61 and is radiated towards an object, is reflected back to the light-receiving device 62 by that object. The detection light reflected by the object passes through one of the spaces between adjacent legs 70 and impinges on the light-receiving surface 64. Based on the detection light received by the light-receiving device 62, the controller 100 detects whether one or more objects is (are) present in the surroundings of the main body 2. Based on the detection light received by the light-receiving device 62, the light-receiving device 62 and/or the controller 100 may determine the distance(s) to the object(s).

The light-emitting surface 63 and the light-receiving surface 64 are each disposed upward of the upper surface 2A of the main body 2. The detection light emitted, e.g., forward, from the light-emitting surface 63 passes through the spaces upward of the upper surface 2A of the main body 2 and is radiated towards objects, e.g., that are forward of the main body 2. If the detection light is radiated towards an object forward of the main body 2, then the detection light reflected by the object passes through the space upward of the upper surface 2A on the front side of the main body 2 and impinges on the light-receiving surface 64. Therefore, the optical sensor 50 can detect objects that are, e.g., forward of the main body 2 without being hindered by the main body 2.

As was described above, the light-emitting device 61 and the light-receiving device 62 are each fixed to the rotary body 51. Therefore, when the rotary body 51 rotates about rotational axis CX, the light-emitting device 61 emits the detection light radially outwardly as it rotates 360°. The light-receiving device 62 also receives the detection light while the rotary body 51 is rotating. Because the light-emitting device 61 emits detection light while the rotary body 51 is rotating, the detection light is radiated towards objects that surround the main body 2 in all directions. Based on the detection light received by the light-receiving device 62, the controller 100 can detect objects in the surroundings of the main body 2.

In the present embodiment, the rotary body 51 rotates in the rotational direction indicated by arrow RT in FIG. 10. In the explanation below, the orientation (rotational direction) indicated by arrow RT (clockwise direction in FIG. 10) is referred to as the "forward-rotation side" where appropriate, and the orientation (rotational direction) that is the reverse (counterclockwise direction in FIG. 10) of the orientation indicated by arrow RT is referred to as the "reverse-rotation side" where appropriate.

Figure 11:
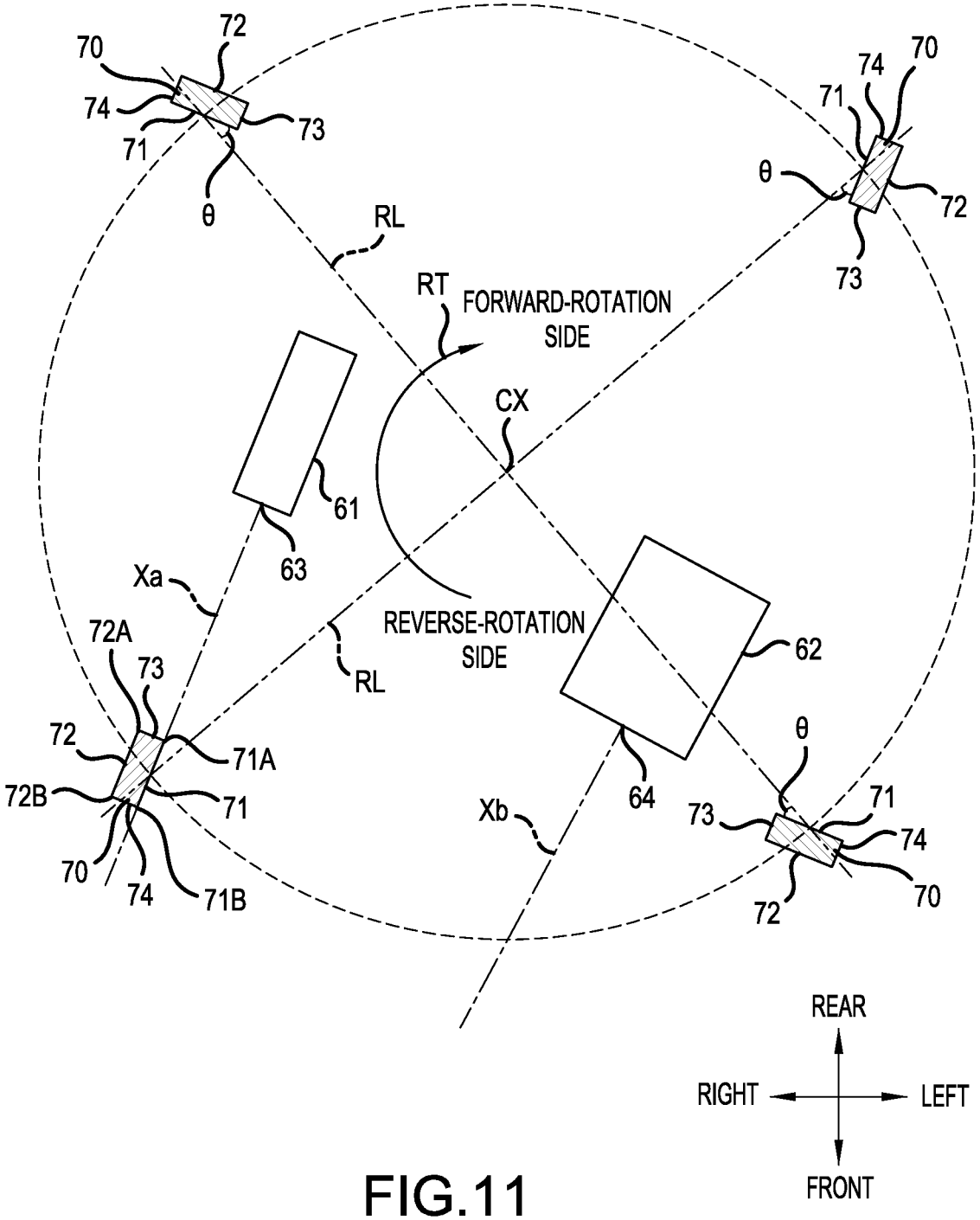
FIG. 11 is a cross-sectional view that schematically shows a light-emitting device, a light-receiving device, and the legs according to the first embodiment.

FIG. 11 is a cross-sectional view that schematically shows the light-emitting device 61, the light-receiving device 62, and the legs 70 according to the present (first) embodiment in one rotational position of the (rotatable) rotary body 51 relative to the (stationary) legs 70. As shown in FIG. 11, the light-emitting surface 63 of the light-emitting device 61 and the light-receiving surface 64 of the light-receiving device 62 are disposed at different locations in the rotational direction of the rotary body 51. In the present embodiment, the light-emitting surface 63 is disposed on the forward-rotation side of the light-receiving surface 64. In addition, the light-emitting surface 63 is disposed on one side of rotational axis CX (in the example shown in FIG. 11, on the right side of rotational axis CX), and the light-receiving surface 64 is disposed on the other side of rotational axis CX (in the example shown in FIG. 11, on the left side of rotational axis CX).

In a cross section orthogonal to rotational axis CX, an optical axis Xa of an optical system of the light-emitting device 61 is inclined with respect to virtual (imaginary) radial lines RL (hereinafter, simply "virtual line RL") that extend radially outward emanating from rotational axis CX, i.e. radial lines that intersect rotational axis CX and are perpendicular thereto. (In FIG. 11, although four virtual radial lines RL are shown by dot-dashed lines, the following description will refer to one (i.e. any one) of the virtual lines RL in the singular, because the various axes are inclined relative to any virtual radial line RL emanating from rotational axis CX.) In a cross section orthogonal to rotational axis CX, an optical axis Xb of an optical system of the light-receiving device 62 also is inclined with respect to virtual line RL of rotational axis CX. It is noted that virtual line RL may also be defined as a (any) line that, in a cross section orthogonal to rotational axis CX, passes through (intersects) rotational axis CX and extends in the radial direction of rotational axis CX. Optical axis Xa and optical Xb are preferably not parallel, but rather are inclined relative to each other so that the optical axes Xa and Xb intersect in a direction forward (emission direction) of the light emitting surface 63.

As described above, in the present embodiment, the light-emitting device 61 emits laser light as the detection light. The light beam of the detection light emitted from the light-emitting device 61 coincides with optical axis Xa of the light-emitting device 61. At least a portion of the light beam of the detection light that enters the light-receiving device 62 coincides with optical axis Xb of the light-receiving device 62.

In a cross section orthogonal to rotational axis CX, at least a portion of a surface of each leg 70 is inclined with respect to virtual line RL.

In the cross section orthogonal to rotational axis CX, the outer shape of each leg 70 is oblong, e.g., rectangular. In the cross section orthogonal to rotational axis CX, each leg 70 includes a first (flat) side surface 71, a second (flat) side surface 72 parallel to the first side surface 71, an inner surface 73, and an outer surface 74. The first side surface 71 and the second side surface 72 are each inclined (oblique) with respect to virtual line RL, in particular with regard to virtual lines RL that intersect the first side surface 71.

The first side surface 71 faces a direction opposite the direction faced by the second side surface 72, i.e. these surfaces are parallel. The inner surface 73 faces a direction opposite the direction faced by the outer surface 74, i.e. these surfaces are parallel. In the present embodiment, the first side surface 71 faces the reverse-rotation side. The second side surface 72 faces the forward-rotation side. The inner surface 73 faces inward in the radial direction of rotational axis CX. The outer surface 74 faces outward in the radial direction of rotational axis CX. The distance between the first side surface 71 and the second side surface 72 is shorter than the distance between the inner surface 73 and the outer surface 74.

The first side surface 71 has an inner-end part 71A on the innermost side of rotational axis CX in the radial direction and an outer-end part 71B on the outermost side of rotational axis CX in the radial direction. The first side surface 71 is inclined such that the inner-end part 71A is disposed on the forward-rotation side of the outer-end part 71B. The second side surface 72 has an inner-end part 72A on the innermost side of rotational axis CX in the radial direction and an outer-end part 72B on the outermost side of rotational axis CX in the radial direction. The second side surface 72 is inclined such that the inner-end part 72A is disposed on the forward-rotation side of the outer-end part 72B.

In the cross section orthogonal to rotational axis CX, an inclination angle θ of the first side surface 71 with respect to virtual line RL and the inclination angle θ of the second side surface 72 with respect to virtual line RL are 5° or greater and 85° or less, i.e. from 5° to 85°. This inclination angle θ emanates from a point (vertex) where one virtual radial line RL intersects the first side surface 71 or the second side surface 72 while the optical axis Xa coincides with the first side surface 71 or the second side surface 72, respectively. In addition or in the alternative, this inclination angle θ emanates from a point (vertex) where one virtual radial line RL intersects a middle point of the first side surface 71 or the second side surface 72, respectively, in the cross-section orthogonal to the rotational axis CX. In one exemplary example, this inclination angle θ may be 20° or greater and 70° or less, i.e. from 20° to 70°. In another exemplary example, this inclination angle θ may be 30° or greater and 40° or less, i.e. from 30° to 40°. It is noted that, the inclination angle θ also may be prescribed based on the inclination angle of optical axis Xa of the light-emitting device 61 with respect to a virtual line RL that intersects a middle point of the first surface 71 while the optical axis Xa coincides with the first surface 71.

In the present embodiment, at least one of the first side surface 71 and the second side surface 72 are inclined such that it is (they are) parallel to, or coincide(s) with, optical axis Xa of the light-emitting device 61 when at least a portion of the leg 70 opposes (faces) the light-emitting surface 63 of the light-emitting device 61. In the example shown in FIG. 11, the first side surface 71 coincides with optical axis Xa when the first side surface 71 and optical axis Xa overlap in a cross section orthogonal to rotational axis CX. It is noted that the second side surface 72 may coincide with optical axis Xa when the second side surface 72 and optical axis Xa overlap in the cross section orthogonal to rotational axis CX.

In the present embodiment, the shapes and the dimensions of all four of the legs 70 are identical. More specifically, the inclination directions and inclination angles θ of the legs 70 with respect to the four virtual lines RL depicted in FIG. 11 are identical.

According to the present embodiment, because the first side surface 71 and the second side surface 72 become parallel to, or coincide with, optical axis Xa of the light-emitting device 61 when at least a portion of the leg 70 opposes (faces) the light-emitting surface 63 of the light-emitting device 61, the leg 70 blocks less of the detection light, which is emitted from the light-emitting surface 63 than if the surfaces of the leg 70 are (as in the known art described above) arranged to be parallel or substantially parallel to the virtual radial lines RL. For example, even if the outer shape of the leg 70 is enlarged (widened) such that the distance between the first side surface 71 and the second side surface 72 becomes longer (wider), the time during which the detection light, which is emitted from the light-emitting surface 63 during rotation of the rotary body 51, is blocked by the leg 70 does not become excessively long. Because a greater amount of the detection light emitted from the light-emitting surface 63 is radiated towards objects (i.e. less detection light is blocked by the legs 70), the detection accuracy of the optical sensor 50 can be improved as compared to known optical sensors. In addition, by enlarging (widening) the outer shape of the leg 70 such that the distance between the first side surface 71 and the second side surface 72 becomes longer (wider), the legs 70 may be made more robust, thereby providing stronger support for the cover 52.

Castors

Figure 12:
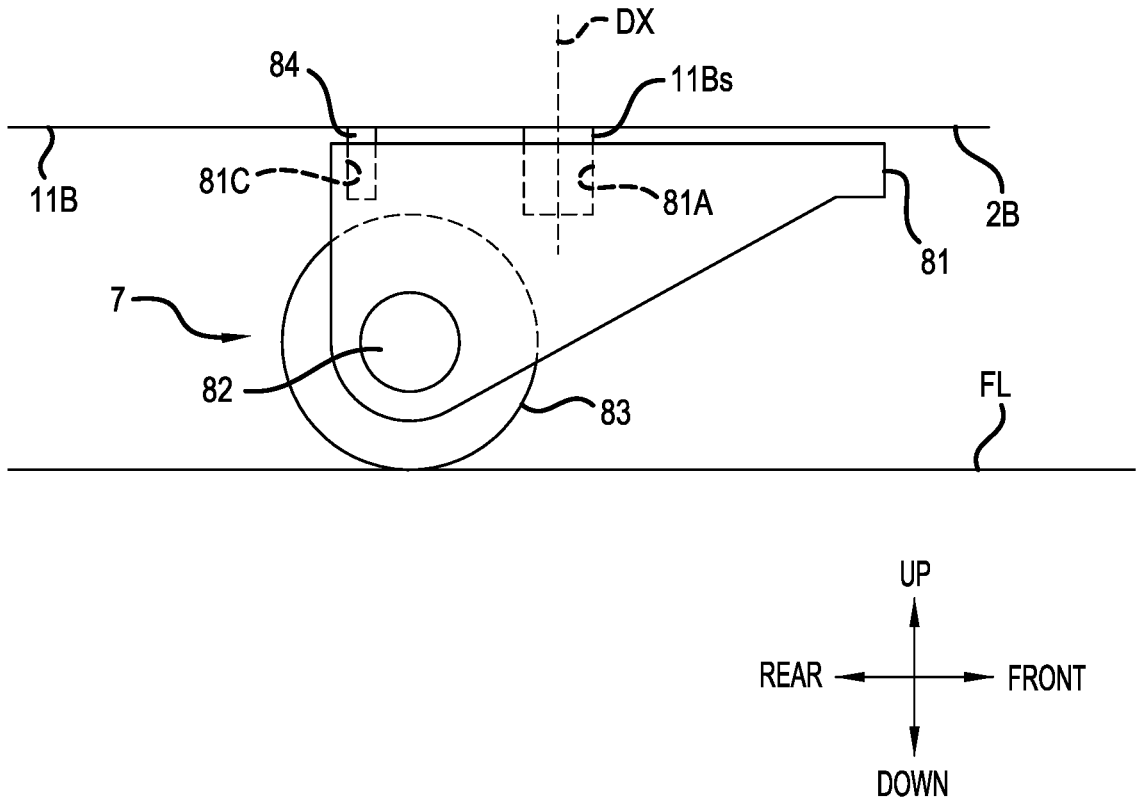
FIG. 12 is a side view that schematically shows a castor according to the first embodiment.
Figure 13:
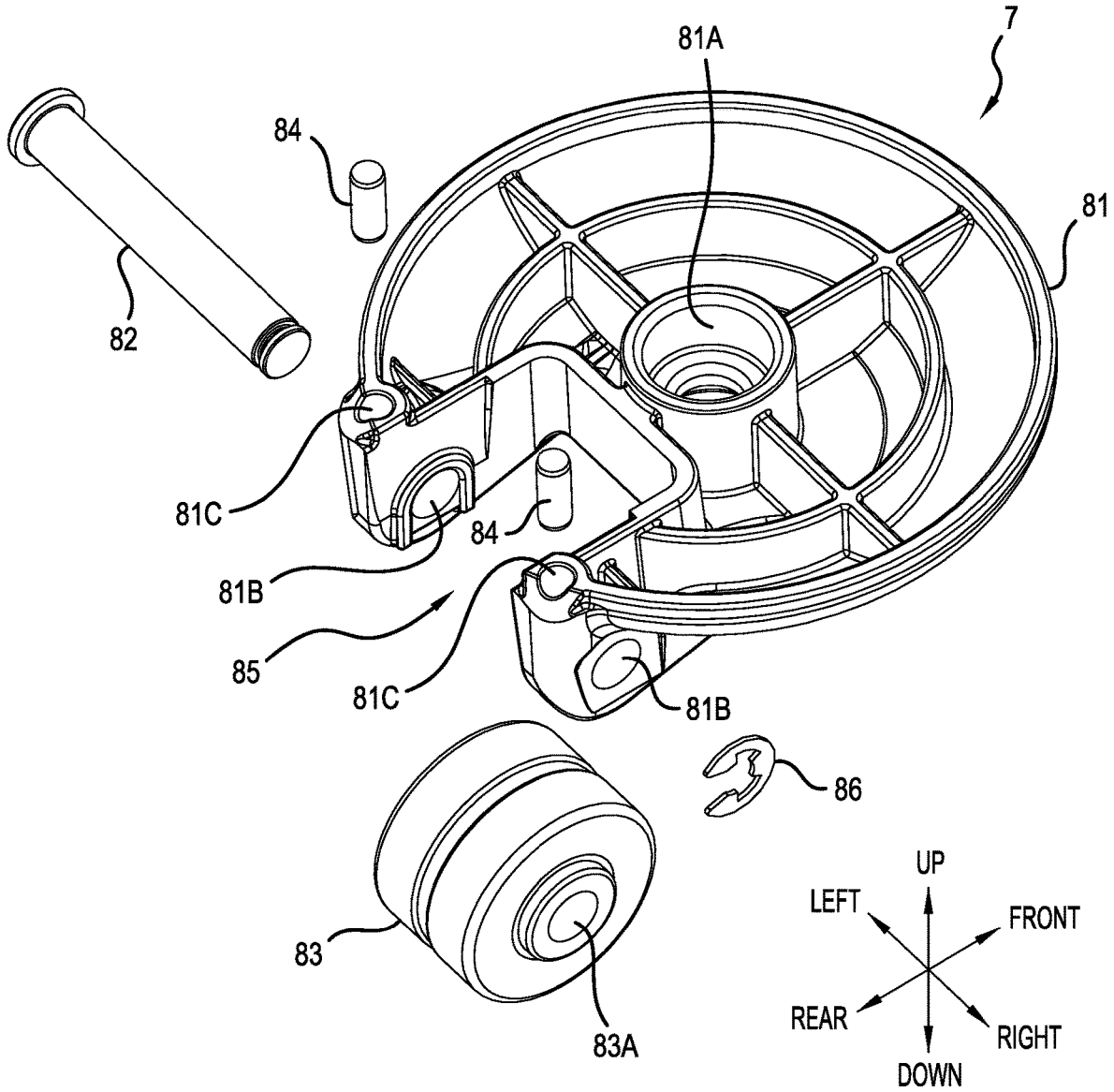
FIG. 13 is an exploded oblique view of the castor of FIG. 12.

FIG. 12 is a side view that schematically shows one of the castors 7 according to the present embodiment. FIG. 13 is an exploded oblique view of the castor 7 of FIG. 12. The castor 7 shown in FIGS. 12 and 13 is provided on the rear portion of the bottom surface 2B and is coupled to the lower housing 11B.

The castor 7 comprises: a rotary member 81, which is rotatably coupled to the lower housing 11B; a wheel 83, which is rotatably mounted on the rotary member 81 via a shaft 82; and two pins 84, which are mounted on the rotary member 81.

The rotary member 81 rotates about a rotational axis DX, which extends in the up-down direction, i.e. vertical direction relative to the surface-to-be-cleaned FL. The lower housing 11B comprises a support shaft 11Bs, which rotatably supports the rotary member 81. The support shaft 11Bs protrudes downward from the bottom surface 2B of the main body 2. The rotary member 81 has a hole 81A, into which the support shaft 11Bs is inserted. The hole 81A is provided in an upper surface of the rotary member 81. When the support shaft 11Bs is disposed in the hole 81A, the rotary member 81 is rotatable about rotational axis DX.

As shown in FIG. 13, a recessed part 85 is provided in a portion of the rotary member 81. The rotary member 81 has holes 81B provided on both sides of the recessed part 85.

The wheel 83 has a hole 83A, into which the shaft 82 is inserted. The wheel 83 is disposed in the recessed part 85. When the wheel 83 is disposed in the recessed part 85, the shaft 82 is inserted into the holes 81B of the rotary member 81 and the hole 83A of the wheel 83. When the shaft 82 is disposed in the holes 81B of the rotary member 81 and the hole 83A of the wheel 83, a tip part of the shaft 82 and the wheel 83 are fixed by a stop ring 86.

The two pins 84 are respectively inserted in two holes 81C, which are provided in the upper surface of the rotary member 81. The holes 81C are provided outward of the hole 81A in the radial direction of rotational axis DX. The pins 84 are inserted into the holes 81C such that upper-end parts of the pins 84 protrude upward of the upper surface of the rotary member 81.

The hardness of the pins 84 is greater than the hardness of the rotary member 81. Therefore, the pins 84 tend to wear less than the rotary member 81. In the present embodiment, the pins 84 are made of metal. The rotary member 81 is made of synthetic polymer (resin).

When the pins 84 are inserted into the holes 81C, the upper-end parts of the pins 84 make contact with the bottom surface 2B. In the present embodiment, the upper-end parts of the pins 84 are disposed upward of the upper surface of the rotary member 81. Consequently, contact between the upper surface of the rotary member 81 and the bottom surface 2B is prevented.

The rotary member 81 is rotatable while the upper-end parts of the pins 84 contact the bottom surface 2B. Therefore, when the rotary member 81 rotates, the upper surface of the rotary member 81 and the bottom surface 2B do not rub against one another. Consequently, wear of the rotary member 81 is prevented. As was noted above, because the pins 84 are made of metal, they tend to wear less than the rotary member 81. Consequently, even though the rotary member 81 rotates, deterioration of the pins 84 is prevented or at least minimized.

It is noted that, when the pins 84 are inserted into the holes 81C, the upper-end parts of the pins 84 and the upper surface of the rotary member 81 may be disposed at the same height. In addition, when the upper-end parts of the pins 84 contact the bottom surface 2B, the upper surface of the rotary member 81 may contact the bottom surface 2B.

Side Brushes

Figure 14:
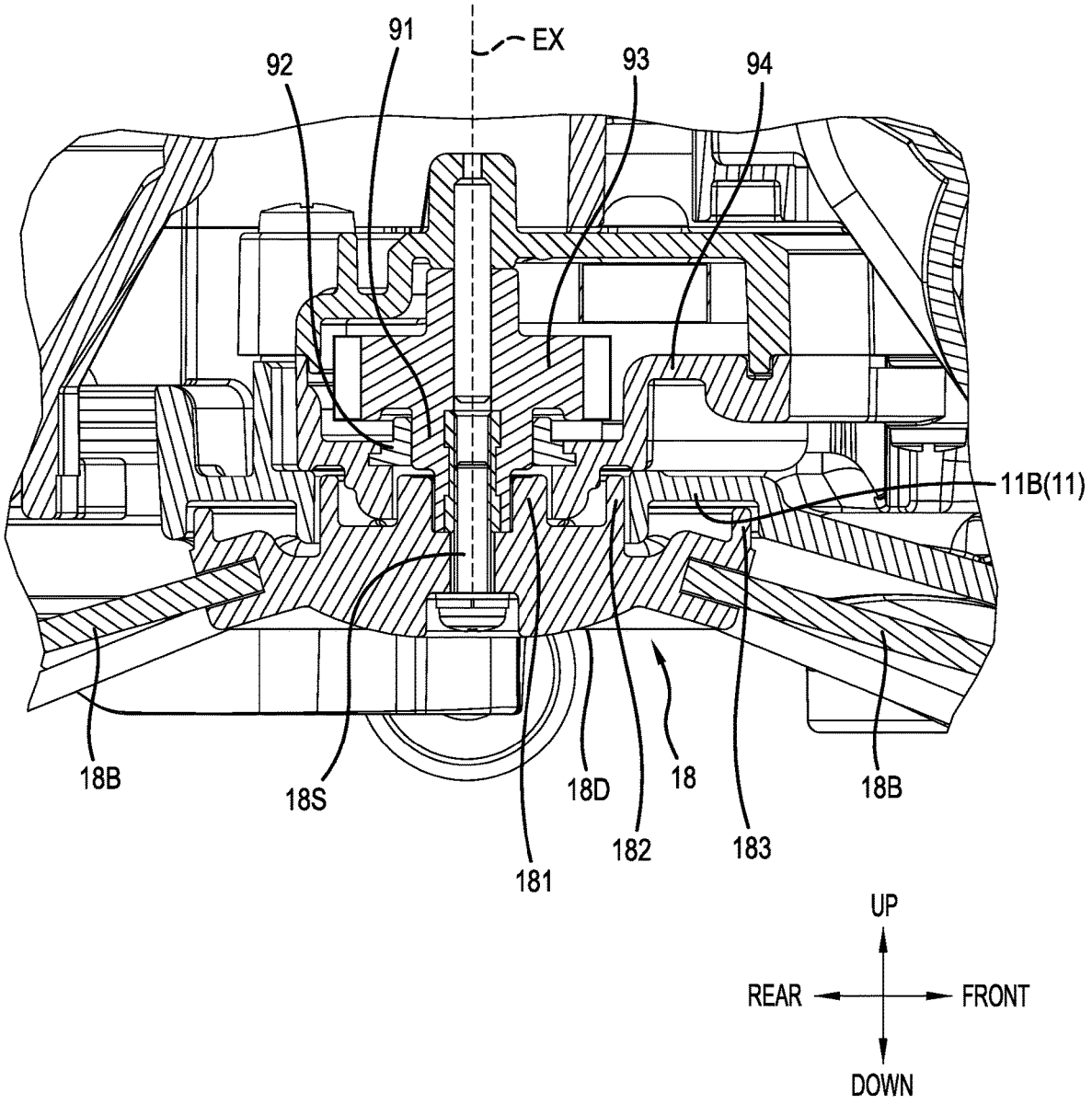
FIG. 14 is a cross-sectional view of a side brush according to the first embodiment.

FIG. 14 is a cross-sectional view of one of the side brushes 18 according to the present embodiment. As was explained above, each side brush 18 of the present embodiment comprises the brushes 18B connected to the disk 18D in a radially extending manner. The disk 18D is disposed in the lower housing 11B and rotates about a rotational axis EX, which extends in the up-down direction.

A lower surface of the disk 18D opposes the surface-to-be-cleaned FL. The lower surface of the disk 18D includes a curved surface. Therefore, the lower surface of the disk 18D is inclined outward in the radial direction of rotational axis EX and upward. In a cross section parallel to rotational axis EX, the lower surface of the disk 18D has an arcuate shape that protrudes downward. In the present embodiment, the lower surface of the disk 18D has a semispherical shape.

Because the lower surface of the disk 18D includes a curved surface, even if the lower surface of the disk 18D contacts the surface-to-be-cleaned FL, obstruction of the rotation of the disk 18D is minimal, thereby minimizing or avoiding damage to the surface-to-be-cleaned FL. For example, if the surface-to-be-cleaned FL is a carpet surface, then the disk 18D tends not to embed in the carpet. In addition, even if the lower surface of the disk 18D contacts the carpet surface, there is little or no increase in the rotational resistance of the disk 18D. In addition, even if the lower surface of the disk 18D contacts the surface-to-be-cleaned FL while the robotic vacuum 1 is travelling across the surface-to-be-cleaned FL owing to the driving of the travelling apparatus 12, the disk 18D tends not to get stuck in or on the surface-to-be-cleaned FL. Consequently, the robotic vacuum 1 can smoothly travel across the surface-to-be-cleaned FL owing to the curved shape of the disk 18D.

As shown in FIG. 14, the robotic vacuum 1 comprises: a rotary shaft 91, which is disposed in the interior space of the housing 11; a bearing 92, which rotatably supports the rotary shaft 91; a gear part 93, which is connected to the rotary shaft 91; and a gear housing 94, which is disposed around the gear part 93 in the interior space of the housing 11. The gear housing 94 supports the bearing 92.

The power generated by the side-brush motor 19 is transmitted to the rotary shaft 91 via the gear part 93. The rotary shaft 91 rotates about rotational axis EX owing to the rotational drive of the side-brush motor 19.

The disk 18D is coupled or fixed to the lower-end part of the rotary shaft 91 by a screw 18S. Owing to the rotation of the rotary shaft 91, the side brush 18 rotates about rotational axis EX.

Each disk 18D comprises: an inner-tube part (boss) 181, into which the lower-end part of the rotary shaft 91 is inserted; a first outer-tube part (boss) 182, which is disposed around the inner-tube part 181; and a second outer-tube part (boss) 183, which is disposed around the first outer-tube part 182.

The height of an upper-end surface of the inner-tube part 181 is the same as the height of an upper-end surface of the first outer-tube part 182. It is noted that the upper-end surface of the first outer-tube part 182 may be disposed at a location higher than the upper-end surface of the inner-tube part 181. The upper-end surface of the second outer-tube part 183 may be disposed at a location that is lower than the upper-end surface of the inner-tube part 181 and the upper-end surface of the first outer-tube part 182.

A portion of the gear housing 94 is disposed in the space between the inner-tube part 181 and the first outer-tube part 182. The gear housing 94 does not (directly) contact the disk 18D. A portion of the gear housing 94 opposes (faces) an outer-circumference surface of the inner-tube part 181 across a minute gap. A portion of the gear housing 94 opposes (faces) the upper-end surface of the first outer-tube part 182 across a minute gap. A first labyrinth seal is formed between the inner-tube part 181 and the first outer-tube part 182 on one side and the gear housing 94 on the other side.

A portion of the lower housing 11B is disposed in the space between the first outer-tube part 182 and the second outer-tube part 183. The lower housing 11B does not contact the disks 18D. A portion of the lower housing 11B opposes (faces) the outer-circumference surface of the first outer-tube part 182 across a minute gap. A portion of the lower housing 11B opposes (faces) the upper-end surface of the second outer-tube part 183 across a minute gap. A second labyrinth seal is formed between the first outer-tube part 182 and the second outer-tube part 183 on one side and the lower housing 11B on the other side.

The formation of the labyrinth seals hinders or obstructs the ingress of foreign matter into the space around the rotary shaft 91. If hair-like foreign matter, such as hair and threads, present on the surface-to-be-cleaned FL contacts the rotary shaft 91, then there is a possibility that rotation of the rotary shaft 91 will be hindered. In the present embodiment, the labyrinth seals are formed around the rotary shaft 91. Consequently, hair-like foreign matter is hindered from penetrating into the space around the rotary shaft 91.

Effects

According to the first embodiment as explained above, in a cross section orthogonal to rotational axis CX of the rotary body 51, at least a portion of the surface (preferably, a flat surface) of the leg 70 is inclined (oblique, slanted) with respect to virtual line RL emanating from rotational axis CX. Consequently, even if the cross-sectional area of the leg 70 is enlarged (e.g., widened), the time during which the detection light, which is emitted from the light-emitting surface 63 while the rotary body 51 is rotating, is blocked by the leg 70 does not become excessively long. By reducing the amount of the detection light that is blocked by each of the legs 70, improved detection accuracy of the optical sensor 50 is made possible. In addition, by the enlarging of the cross-sectional area of each of the legs 70, the legs 70 can be made more robust with minimal effect on (reduction of) the detection accuracy.

In the present embodiment, when at least a portion of the leg 70 opposes (faces) the light-emitting surface 63 of the light-emitting device 61, the corresponding first side surface 71 and the corresponding second side surface 72 are each parallel to, or coincide with, optical axis Xa of the light-emitting device 61. Consequently, for example, even if the outer shape of the leg 70 is enlarged (widened) such that the distance between the first side surface 71 and the second side surface 72 becomes longer (wider), the time during which the detection light, which is emitted from the light-emitting surface 63 during rotation of the rotary body 51, is blocked by the leg 70 does not become excessively long. Thus, as was explained above, by reducing the amount of the detection light that is blocked by each of the legs 70, improved detection accuracy of the optical sensor 50 is made possible. Moreover, by the enlarging of the cross-sectional area of each of the legs 70, the legs 70 can be made more robust with minimal effect on (reduction of) the detection accuracy.

Modified Example

It is noted that, in a modification of the first embodiment described above, the inclination angles θ of the legs 70, with respect to a virtual line RL that intersects a middle point of the respective leg 70, may differ from one another. For example, the inclination angle θ of a first leg 70 may be 30°, and the inclination angle θ of a second leg 70 may be 35°, in accordance with the definitions provided above.

In addition or in the alternative, in the first embodiment described above, four of the legs 70 are provided. However, in the alternative, two or three of the legs 70 or five or more of the legs 70 may be provided around the rotary body 51.

In addition or in the alternative, in another modification of the first embodiment described above, the first side surface 71 and the second side surface 72 do not have to be parallel to one another, as will be demonstrated in additional embodiments described below.

Second Embodiment

A second embodiment will now be explained. In the explanation below, structural elements the same as or equivalent to those in the embodiment described above are assigned the same symbols, and explanations thereof are abbreviated or omitted.

Optical Sensor

Figure 15:
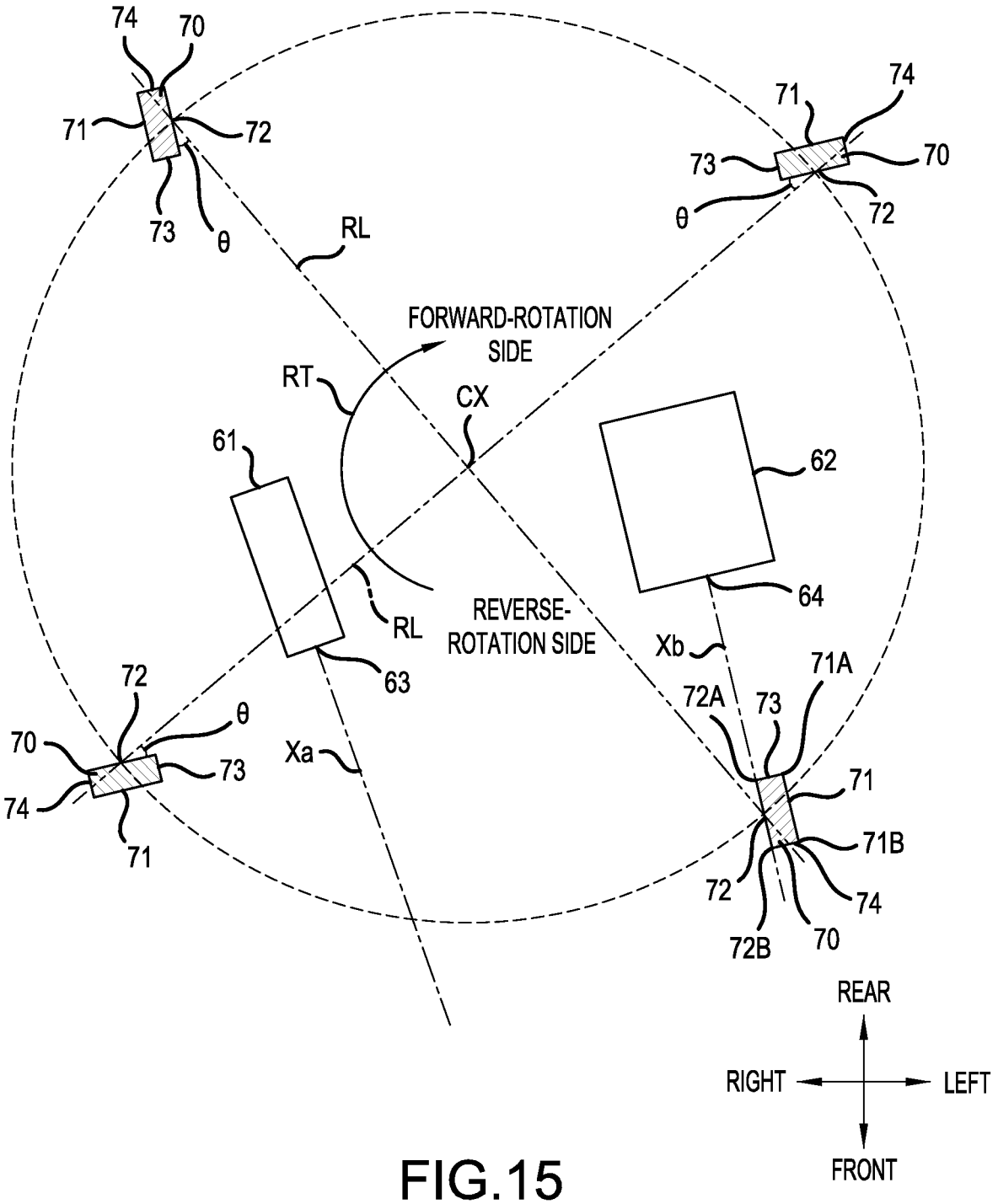
FIG. 15 is a cross-sectional view that schematically shows the light-emitting device, the light-receiving device, and the legs according to a second embodiment of the present teachings.

FIG. 15 is a cross-sectional view that schematically shows the light-emitting device 61, the light-receiving device 62, and the legs 70 according to the present (second) embodiment. The same as in the embodiment described above, in a cross section orthogonal to rotational axis CX, each leg 70 includes the first (flat) side surface 71, the second (flat) side surface 72 parallel to the first side surface 71, the inner surface 73, and the outer surface 74. The first side surface 71 and the second side surface 72 are each inclined (oblique) with respect to virtual line RL (i.e. with respect to a virtual line RL that intersects the first side surface 71 or the second side surface 72).

In the present (second) embodiment, the first side surface 71 is inclined such that the inner-end part 71A is disposed on the reverse-rotation side of the outer-end part 71B. The second side surface 72 is inclined such that the inner-end part 72A is disposed on the reverse-rotation side of the outer-end part 72B.

In a cross section orthogonal to rotational axis CX, an inclination angle θ of the first side surface 71 with respect to virtual line RL and the inclination angle θ of the second side surface 72 with respect to virtual line RL are 5° or greater and 85° or less, i.e. from 5° to 85°. This inclination angle θ emanates from a point (vertex) where one virtual radial line RL intersects the first side surface 71 or the second side surface 72 while the optical axis Xb coincides with the first side surface 71 or the second side surface 72. In addition or in the alternative, this inclination angle θ emanates from a point (vertex) where one virtual radial line RL intersects a middle point of the first side surface 71 or the second side surface 72, respectively, in the cross-section orthogonal to the rotational axis CX. In one exemplary example, this inclination angle θ may be 20° or greater and 70° or less, i.e. from 20° to 70°. In another exemplary example, this inclination angle θ may be 30° or greater and 40° or less, i.e. from 30° to 40°. It is noted that, the inclination angle θ may be prescribed based on the inclination angle of optical axis Xb of the light-receiving device 62 with respect to a virtual line RL that intersects a middle point of the second side surface 72 while the optical axis Xb coincides with the second side surface 71.

In the present embodiment, at least one of the first side surface 71 and the second side surface 72 is inclined (oblique, slanted) such that it is parallel to, or coincides with, optical axis Xb of the light-receiving device 62 when at least a portion of the leg 70 opposes (faces) the light-receiving surface 64 of the light-receiving device 62. In the example shown in FIG. 15, when the second side surface 72 and optical axis Xb overlap in a cross section orthogonal to rotational axis CX, the second side surface 72 and optical axis Xb are parallel or coincide. It is noted that, when the first side surface 71 and optical axis Xb overlap in a cross section orthogonal to rotational axis CX, the first side surface 71 and optical axis Xb may be parallel or may coincide.

In the present embodiment, the shapes and the dimensions of the legs 70 are identical. More specifically, the inclination directions and inclination angles θ of the legs 70 with respect to the four virtual lines RL depicted in FIG. 15 are identical.

Effects

According to the second embodiment as explained above, when at least a portion of the leg 70 opposes (faces) the light-receiving surface 64 of the light-receiving device 62, because the first side surface 71 and the second side surface 72 are parallel to, or coincide with, optical axis Xb of the light-receiving device 62, less of the detection light, which is reflected by the object, is blocked by the leg 70. For example, even if the outer shape of each of the legs 70 is enlarged (widened) such that the distance between the first side surface 71 and the second side surface 72 becomes longer (wider), the time during which the detection light, which was reflected by the object during rotation of the rotary body 51, is blocked by the leg 70 does not become excessively long. Because more of the detection light reflected by the object impinges on the light-receiving surface 64 (i.e. less light is blocked by the legs 70), the detection accuracy of the optical sensor 50 can be improved as compared to known designs while also making the legs 70 more robust.

Modified Example

It is noted that, in a modification of the second embodiment described above as well, the inclination angles θ of the legs 70, with respect to a virtual line RL that intersects a middle point of the respective leg 70, may differ from one another. For example, the inclination angle θ of a first leg 70 may be 30°, and the inclination angle θ of a second leg 70 may be 35°, in accordance with the definitions provided above.

In addition or in the alternative, in the second embodiment described above, although four of the legs 70 are provided, two or three of the legs 70 or five or more of the legs 70 may instead be provided around the rotary body 51.

In addition or in the alternative, in another modification of the second embodiment described above as well, the first side surface 71 and the second side surface 72 do not have to be parallel to one another.

Third Embodiment

A third embodiment will now be explained. In the explanation below, structural elements the same as or equivalent to those in the embodiment described above are assigned the same symbols, and explanations thereof are abbreviated or omitted.

Figure 16:
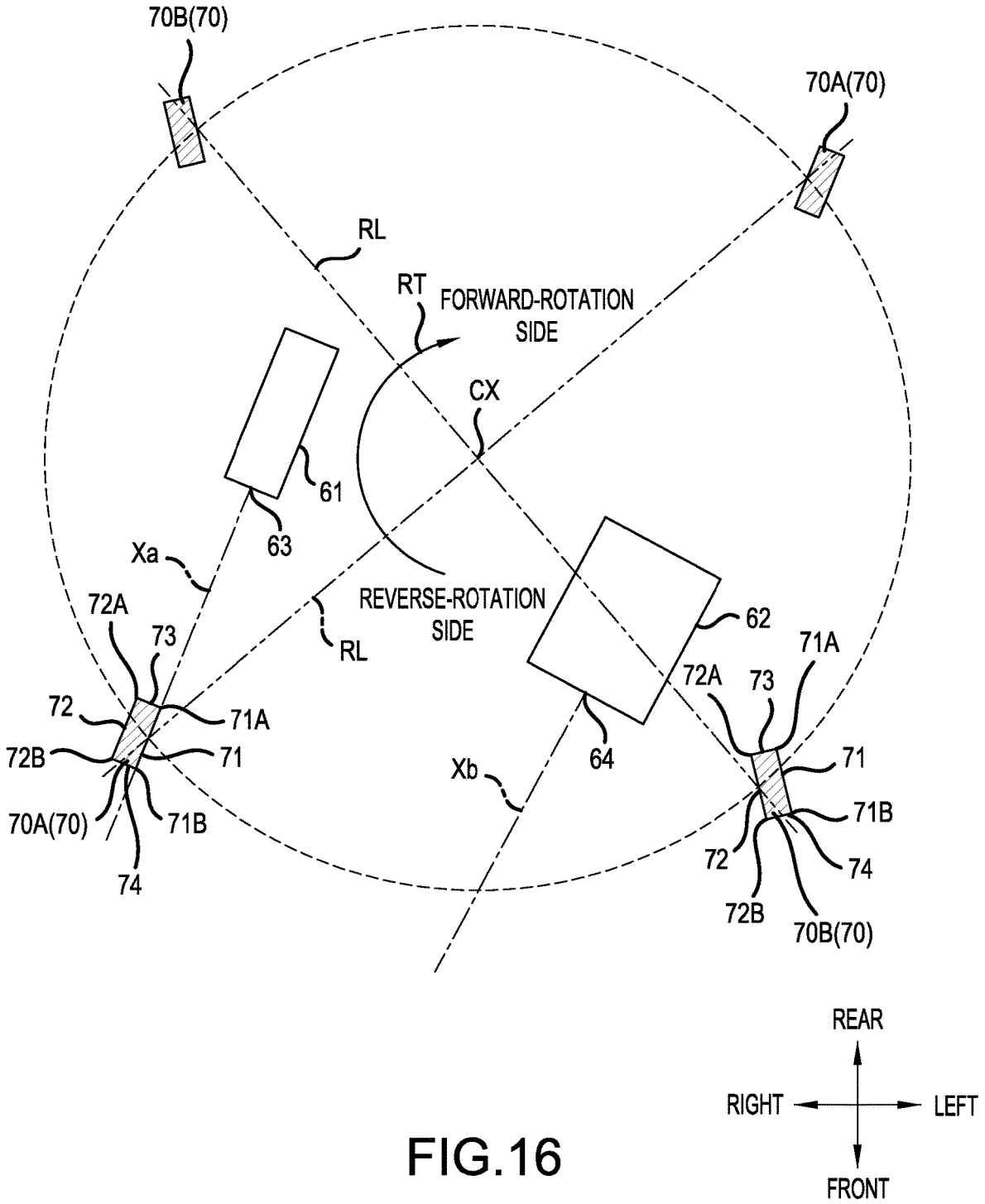
FIG. 16 is a cross-sectional view that schematically shows the light-emitting device, the light-receiving device, and the legs according to a third embodiment of the present teachings.

FIG. 16 is a cross-sectional view that schematically shows the light-emitting device 61, the light-receiving device 62, and the legs 70 according to the present (third) embodiment. As shown in FIG. 16, the legs 70 include first legs 70A and second legs 70B, whose inclination directions differ. In the example shown in FIG. 16, the first legs 70A and the second legs 70B are disposed in an alternating manner around rotational axis CX.

The first (preferably flat) side surface 71 of each first leg 70A is inclined (oblique) such that the corresponding inner-end part 71A is disposed on the forward-rotation side of the corresponding outer-end part 71B. The second (preferably flat) side surface 72 of each first leg 70A is inclined (oblique) such that the corresponding inner-end part 72A is disposed on the forward-rotation side of the corresponding outer-end part 72B.

The first side surface 71 of the second leg 70B is inclined such that the inner-end part 71A is disposed on the reverse-rotation side of the outer-end part 71B. The second side surface 72 of the second leg 70B is inclined such that the inner-end part 72A is disposed on the reverse-rotation side of the outer-end part 72B.

When at least a portion of the first leg 70A opposes (faces) the light-emitting surface 63 of the light-emitting device 61, at least one of the first side surface 71 and the second side surface 72 of that first leg 70A is inclined such that it is parallel to, or coincides with, optical axis Xa of the light-emitting device 61.

At least one of the first side surface 71 and the second side surface 72 of the second leg 70B is inclined such that it is parallel to, or coincides with, optical axis Xb of the light-receiving device 62 when at least a portion of the second leg 70B opposes (faces) the light-receiving surface 64 of the light-receiving device 62.

As explained above, the inclination directions of the legs 70 with respect to a virtual line RL that intersects the respective leg 70 may differ from one another. In the present embodiment, too, a decrease in detection accuracy can be curtailed while increasing the strength of the legs 70. More specifically, the two legs 70A permit a greater amount of detection light to pass (owing to having a cross-section that blocks less light from light-emitting device 61), whereas the two legs 70B permit a greater amount of reflected light to pass (owing to having a cross-section that blocks less reflected light from reaching the light-receiving device 62). Therefore, by generating mapping data using all data that is collected, overall detection accuracy can be improved.

Fourth Embodiment

A fourth embodiment will now be explained. In the explanation below, structural elements the same as or equivalent to those in the embodiment described above are assigned the same symbols, and explanations thereof are abbreviated or omitted.

Figure 17:
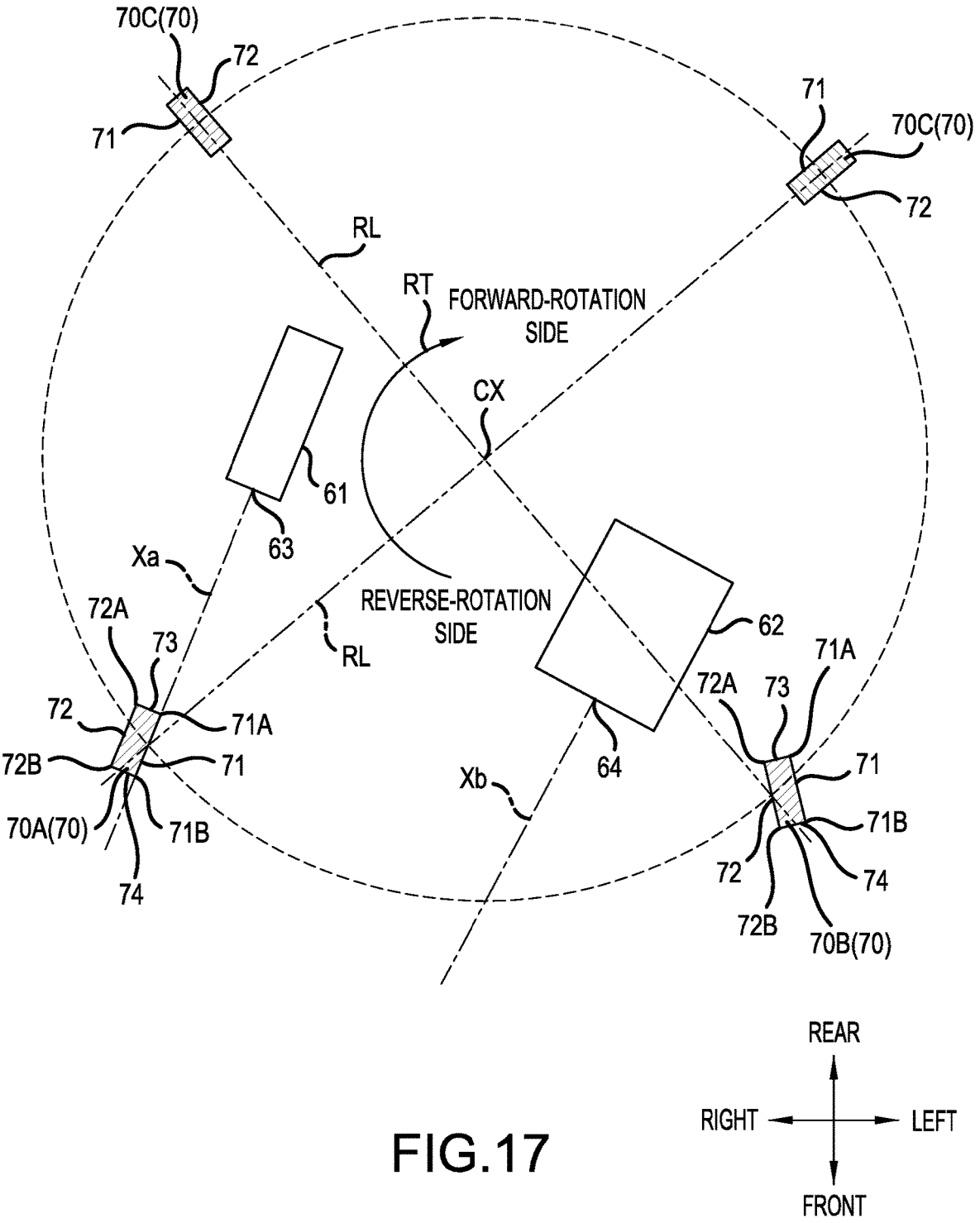
FIG. 17 is a cross-sectional view that schematically shows the light-emitting device, the light-receiving device, and the legs according to a fourth embodiment of the present teachings.

FIG. 17 is a cross-sectional view that schematically shows the light-emitting device 61, the light-receiving device 62, and the legs 70 according to the present (fourth) embodiment. As shown in FIG. 17, the legs 70 comprise the first leg 70A, the second leg 70B, and third legs 70C. The inclination direction of the first leg 70A and the inclination direction of the second leg 70B are respectively the same as the inclination direction of the first leg 70A and the inclination direction of the second leg 70B explained in the third embodiment described above. The first side surface 71 and the second side surface 72 of each third leg 70C is parallel to a virtual line RL that intersects the middle of the respective leg 70C.

As explained above, two of the legs 70A, 70B (from among the plurality of legs 70) are inclined (oblique) with respect to a virtual line RL that intersects it, whereas two of the legs 70C are not inclined with respect to a virtual line RL that intersects a middle of the respective leg 70C. In the present embodiment, too, a decrease in detection accuracy can be curtailed while increasing the strength of the legs 70.

Fifth Embodiment

A fifth embodiment will now be explained. In the explanation below, structural elements the same as or equivalent to those in the embodiment described above are assigned the same symbols, and explanations thereof are abbreviated or omitted.

Optical Sensor

Figure 18:
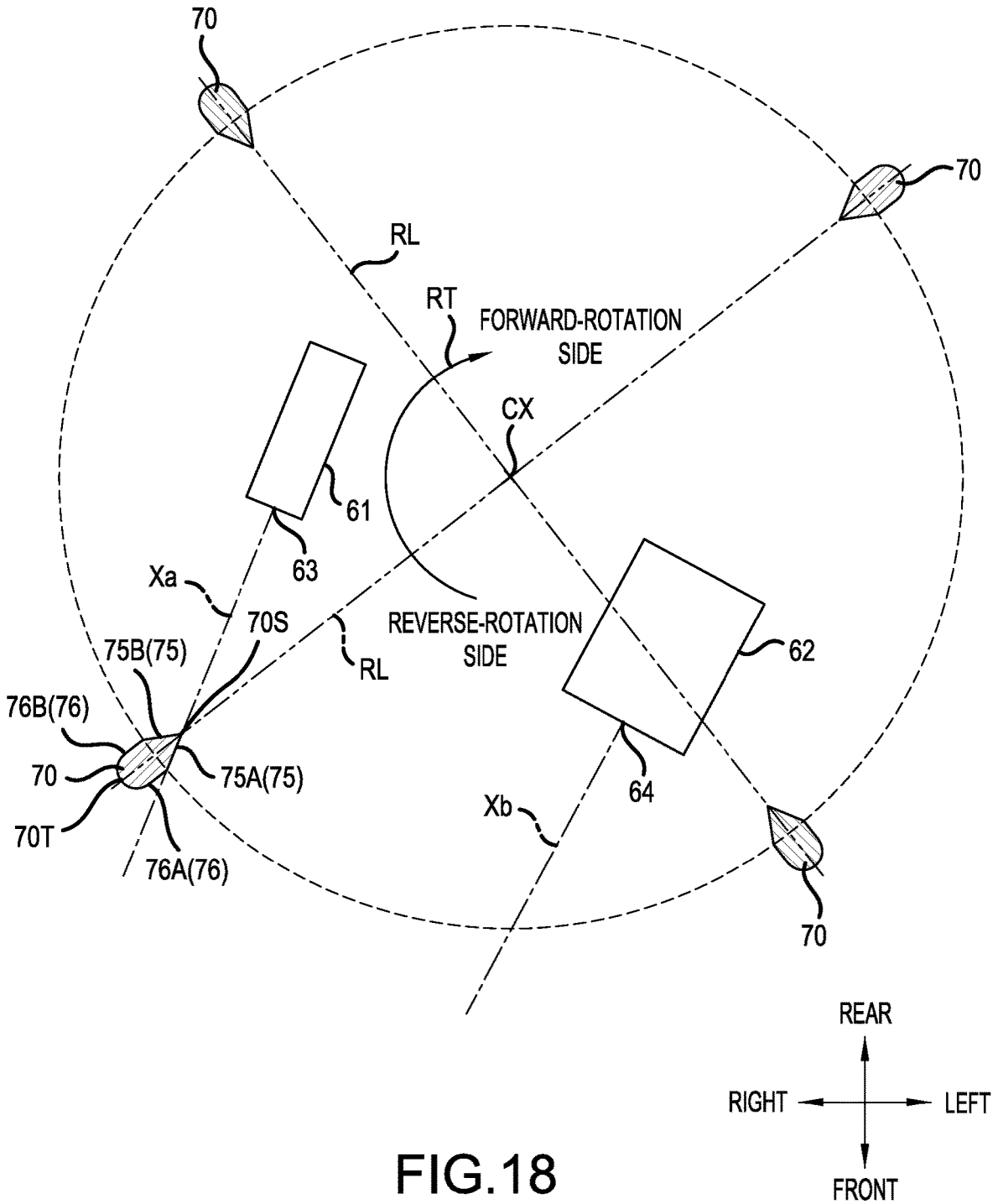
FIG. 18 is a cross-sectional view that schematically shows the light-emitting device, the light-receiving device, and the legs according to a fifth embodiment of the present teachings.
Figure 19:
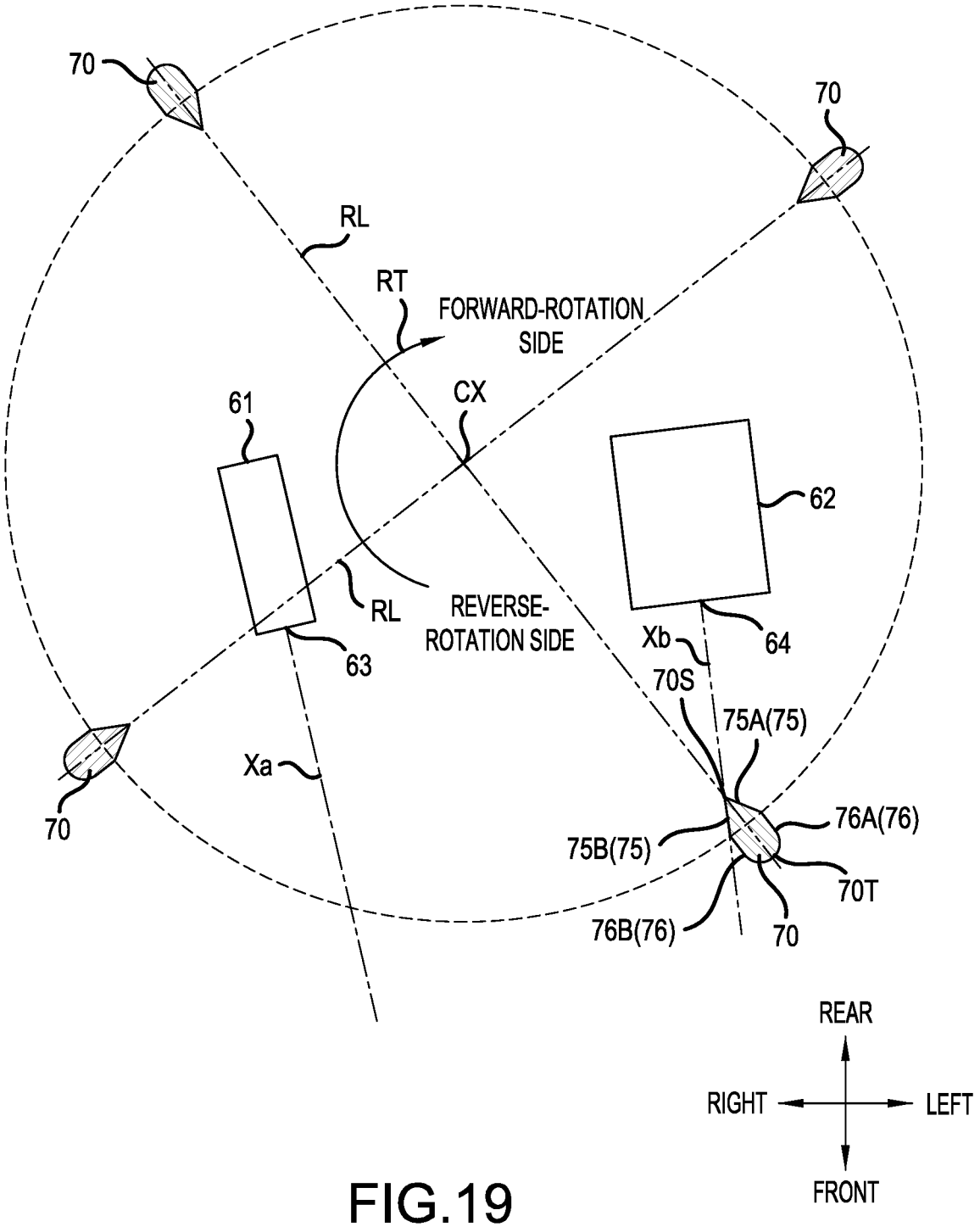
FIG. 19 is a cross-sectional view that schematically shows the light-emitting device, the light-receiving device, and the legs according to the fifth embodiment.
Figure 20:
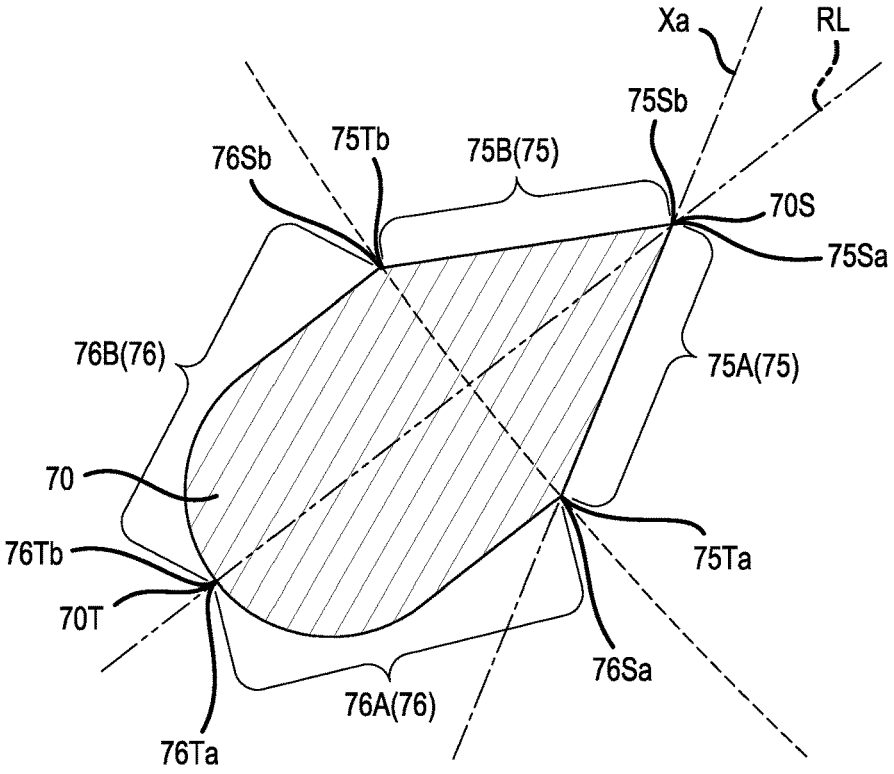
FIG. 20 is a cross-sectional view that schematically shows a leg according to the fifth embodiment.

FIG. 18 and FIG. 19 are each a cross-sectional view that schematically shows the light-emitting device 61, the light-receiving device 62, and the legs 70 according to the present embodiment. FIG. 20 is a cross-sectional view that schematically shows one of the legs 70 according to the present embodiment in greater detail. FIG. 18 shows the state in which, owing to the rotation of the rotary body 51, one of the legs 70 (i.e. the lower, left leg 70) opposes (faces) the light-emitting surface 63. FIG. 19 shows the state in which, owing to the rotation of the rotary body 51, one of the legs 70 (i.e. the lower, right leg 70) opposes (faces) the light-receiving surface 64.

In the present fifth embodiment, each leg 70 includes an inner-end area 75 having an inner-end part 70S in the radial direction of rotational axis CX. The inner-end area 75 has two inclined (flat) surfaces (75A, 75B) with respect to a virtual line RL that intersects the inner-end part 70S. That is, the two flat, inclined surfaces (75A, 75B) of the inner-end area 75 and the virtual line RL intersect at the inner-end part 70S, which is an apex or vertex of the two inclined surfaces (75A, 75B).

More specifically, as shown in FIG. 18 and FIG. 20, the inner-end area 75 includes a first inner-end area (flat surface) 75A, which is inclined relative to the virtual line RL such that the first inner-end area (flat surface) 75A is parallel to, or coincides with, optical axis Xa of the light-emitting device 61 when at least a portion of the leg 70 opposes (faces) the light-emitting surface 63 of the light-emitting device 61. In other words, there is one rotational position of the light-emitting device 61 relative to the leg 70 where optical axis Xa (which is a straight line) coincides (intersects at infinitely many points) with the first inner-end area (flat surface) 75A. In addition, as shown in FIG. 19 and FIG. 20, the inner-end area 75 includes a second inner-end area 75B, which is inclined relative to the virtual line RL such that it is parallel to, or coincides with, optical axis Xb of the light-receiving device 62 when at least a portion of the leg 70 opposes (faces) the light-receiving surface 64 of the light-receiving device 62. In other words, there is one rotational position of the light-receiving device 62 relative to the (same) leg 70 where optical axis Xb (which is a straight line) coincides (intersects at infinitely many points) with the second inner-end area (flat surface) 75B. Consequently, in the present fifth embodiment, the first inner-end 75 of each of the legs 70 has the shape of an isosceles triangle in plan view, whereby the virtual line RL that intersects the inner-end part 70S serves as an axis of symmetry for the first inner-end 75 in plan view.

In addition, each leg 70 includes an outer-end area 76 having an outer-end part 70T in the radial direction of rotational axis CX.

The outer-end area 76 includes: a first outer-end area (surface) 76A, which is connected to the first inner-end area 75A and is partially inclined, in the opposite direction to that of the first inner-end area 75A, with respect to the virtual line RL that intersects the inner-end part 70S and is partially parallel to that virtual line RL; and a second outer-end area (surface) 76B, which is connected to the second inner-end area 75B and is partially inclined, in the opposite direction to that of the second inner-end area 75B, with respect to the virtual line RL that intersects the inner-end part 70S and is partially parallel to that virtual line RL.

The first inner-end area 75A and the first outer-end area 76A each face the reverse-rotation side. The second inner-end area 75B and the second outer-end area 76B each face the forward-rotation side.

An inner-end part 75Sa of the first inner-end area 75A includes the inner-end part 70S of the leg 70. An outer-end part 75Ta of the first inner-end area 75A is connected to an inner-end part 76Sa of the first outer-end area 76A. An outer-end part 76Ta of the first outer-end area 76A includes the outer-end part 70T of the leg 70. The inner-end part 75Sa of the first inner-end area 75A is disposed on the forward-rotation side of the outer-end part 75Ta of the first inner-end area 75A. The inner-end part 76Sa of the first outer-end area 76A is disposed on the reverse-rotation side of the outer-end part 76Ta of the first outer-end area 76A.

An inner-end part 75Sb of the second inner-end area 75B includes the inner-end part 70S of the leg 70. An outer-end part 75Tb of the second inner-end area 75B is connected to an inner-end part 76Sb of the second outer-end area 76B. An outer-end part 76Tb of the second outer-end area 76B includes the outer-end part 70T of the leg 70. The inner-end part 75Sb of the second inner-end area 75B is disposed on the reverse-rotation side of the outer-end part 75Tb of the second inner-end area 75B. The inner-end part 76Sb of the second outer-end area 76B is disposed on the forward-rotation side of the outer-end part 76Tb of the second outer-end area 76B.

In the cross section orthogonal to rotational axis CX, the inner-end area 75 has an angled shape, i.e. the isosceles triangle shape mentioned above. On the other hand, in the cross section orthogonal to rotational axis CX, the outer-end area 76 may include a curvilinear shape, although the shape of the outer-end area 76 is not particularly limited, as long as, e.g., the outer-end area 76 does not block optical axis Xa when optical axis Xa coincides with first inner-end area (surface) 75A or optical axis Xb when optical axis Xb coincides with second inner-end area (surface) 75B. In other words, the outer-end area 76 may preferably be made as wide or even wider than the widest portion of inner-end area 75 in plan view, in order to impart additional strength (robustness) to the leg 70. Therefore, the inner-end area 75 is designed to provide minimal blocking of the optical axes Xa and Xb when the optical axes Xa and Xb respectively rotate past the leg 70, whereas the outer-end area 76 is made wider or thicker in order to increase the overall strength of the leg 70 so that it robustly supports the cover 52.

Effects

In the present fifth embodiment as explained above, in the cross section orthogonal to rotational axis CX of the rotary body 51, at least a portion of the surface of the leg 70 is inclined (oblique) with respect to a virtual line RL of rotational axis CX that intersects the respective leg 70. Consequently, even if the overall cross-sectional area of the leg 70 is enlarged (widened), in particular in the outer-end area 76, the time during which the detection light, which is emitted from the light-emitting surface 63 while the rotary body 51 is rotating, is blocked by the leg 70 does not become excessively long. Because the blocking of the detection light by the legs 70 is curtailed (reduced or minimized), any decrease in the detection accuracy of the optical sensor 50 is curtailed. In addition, by the enlarging of the overall cross-sectional area of each of the legs 70, the strength of the legs 70 can be increased to provide more robust support for the cover 52.

In the present fifth embodiment, the inner-end area 75 and the outer-end area 76 are defined by the surfaces of each of the legs 70. Because the inner-end area 75 has two inclined surfaces with respect to the virtual line RL that bisects it, less of the detection light and the reflected light is blocked by the legs 70 as the rotary body 51 rotates relative to the legs 70. In addition, because the outer-end area 76, which is radially outward of the inner-end area 75, has a greater cross-sectional area than the inner-end area 75 while minimizing blockage of the detection light and the reflected light during rotation of the rotary body 51, the outer-end area 76 serves to impart additional strength to each of the legs 70.

More specifically, the inner-end area 75 includes the first inner-end area (flat surface) 75A and the second inner-end area (flat surface) 75B, which are oppositely inclined (slanted) relative to the bisecting virtual line RL so as to form an isosceles triangle in plan view. Thereby, in both the rotational state (position) in which the leg 70 opposes (faces) the light-emitting surface 63 of the light-emitting device 61 and the rotational state (position) in which the (same) leg 70 opposes (faces) the light-receiving surface 64 of the light-receiving device 62, less of the detection and reflected light is blocked by each of the legs 70.

The outer-end area 76 includes the first outer-end area 76A, which does not extend outward of a virtual extension of the surface of first inner-end area 75A in a first circumferential direction (e.g., clockwise) of the rotary body 51, and the second outer-end area 76B, which does not extend outward of a virtual extension of the surface of second inner-end area 75B in a second circumferential direction (e.g., counterclockwise) of the rotary body 51. Thereby, in both the rotational state (position) in which the leg 70 opposes (faces) the light-emitting surface 63 of the light-emitting device 61 and the rotational state (position) in which the leg 70 opposes (faces) the light-receiving surface 64 of the light-receiving device 62, less of the reflected detection light is blocked by the outer-end area 76 of each of the legs.

Modified Example

In a modification of the present (fifth) embodiment, the outer-end area 76 does not have to be inclined in the opposite direction to that of the inner-end area 75. The outer-end area 76 may have a flat side that is, for example, parallel to, or coincides with, virtual line RL.

Figure 21:
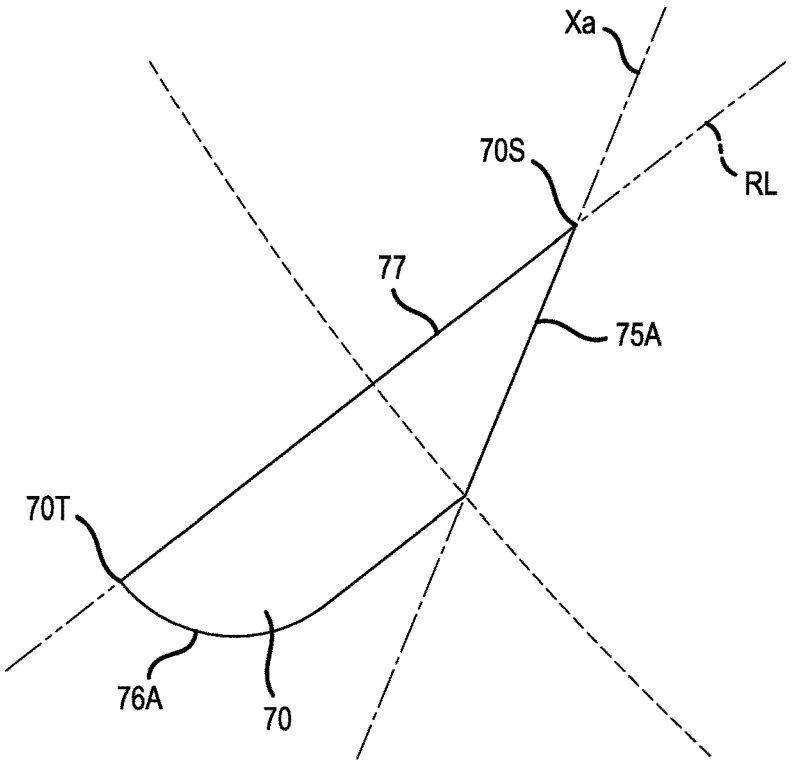
FIG. 21 is a cross-sectional view that schematically shows a leg according to a modified example of the fifth embodiment.

FIG. 21 is a cross-sectional view that schematically shows one of the legs 70 according to this modified example of the fifth embodiment. Each of the legs 70 of this modified example includes: the first inner-end area 75A having the inner-end part 70S in the radial direction of rotational axis CX; and the first outer-end area 76A having the outer-end part 70T in the radial direction of rotational axis CX. When at least a portion of the leg 70 opposes (faces) the light-emitting surface 63 of the light-emitting device 61, the first inner-end area 75A is inclined such that it is parallel to, or coincides with, optical axis Xa of the light-emitting device 61. The first outer-end area 76A is partially inclined, in the opposite direction to that of the first inner-end area 75A, with respect to virtual line RL. In the example shown in FIG. 21, the surfaces of the leg 70 include a flat surface 77, which coincides with virtual line RL shown in FIG. 21. It is noted that, in the example shown in FIG. 21, the first outer-end area 76A does not have to be partially inclined in the opposite direction to that of the first inner-end area 75A. The first outer-end area 76A may, for example, include a portion that is parallel to virtual line RL and a portion that is perpendicular to virtual line RL.

Figure 22:
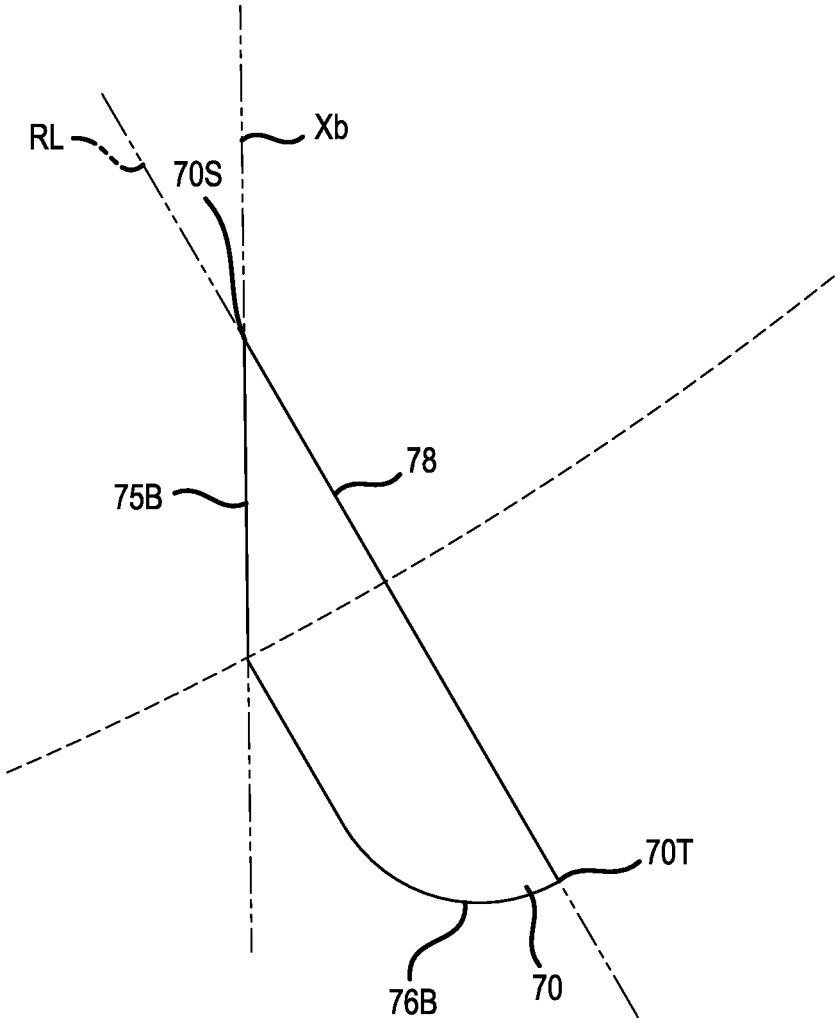
FIG. 22 is a cross-sectional view that schematically shows the leg according to the modified example of the fifth embodiment.

FIG. 22 is a cross-sectional view that schematically shows one of the legs 70 according to another modified example of the fifth embodiment. Each of the legs 70 of this modified example includes: the second inner-end area 75B having the inner-end part 70S in the radial direction of rotational axis CX; and the second outer-end area 76B having the outer-end part 70T in the radial direction of rotational axis CX. When at least a portion of the leg 70 opposes (faces) the light-receiving surface 64 of the light-receiving device 62, the second inner-end area 75B is inclined such that it is parallel to, or coincides with, optical axis Xb of the light-receiving device 62. The second outer-end area 76B is partially inclined, in the opposite direction to that of the second inner-end area 75B, with respect to virtual line RL, and is partially parallel to virtual line RL. In the example shown in FIG. 22, the surfaces of the leg 70 include a flat surface 78, which coincides with the virtual line RL shown in FIG> 22. It is noted that, in the example shown in FIG. 22, the second outer-end area 76B does not have to be partially inclined in the opposite direction to that of the second inner-end area 75B. The second outer-end area 76B may, for example, include a portion that is parallel to virtual line RL and a portion that is perpendicular to virtual line RL.

Sixth Embodiment

A sixth embodiment will now be explained. In the explanation below, structural elements the same as or equivalent to those in the embodiment described above are assigned the same symbols, and explanations thereof are abbreviated or omitted.

Figure 23:
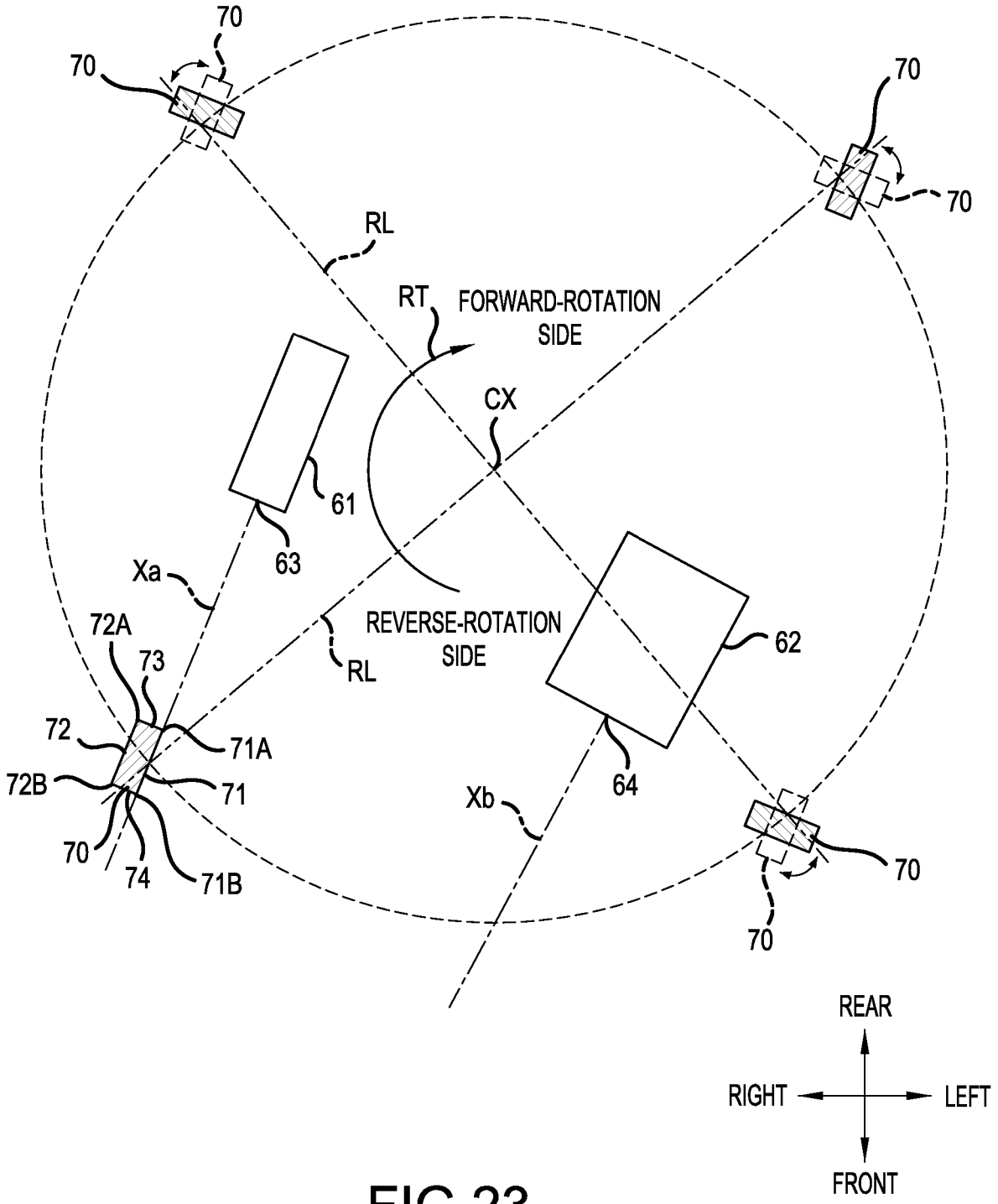
FIG. 23 is a cross-sectional view that schematically shows the light-emitting device, the light-receiving device, and the legs according to a sixth embodiment of the present teachings.

FIG. 23 is a cross-sectional view that schematically shows the light-emitting device 61, the light-receiving device 62, and the legs 70 according to the present (sixth) embodiment. As shown in FIG. 23, the legs 70 are rotatable in the cross section orthogonal to rotational axis CX. That is, each of the legs 70 is respectively rotatable about axes that are each parallel to rotational axis CX.

Each leg 70 rotates such that, when it opposes (faces) the light-emitting surface 63 of the light-emitting device 61, at least one of the corresponding first side surface 71 and the corresponding second side surface 72 is parallel to, or coincides with, optical axis Xa of the light-emitting device 61. In addition, each leg 70 rotates such that, when it opposes (faces) the light-receiving surface 64 of the light-receiving device 62, at least one of the corresponding first side surface 71 and the corresponding second side surface 72 is parallel to, or coincides with, optical axis Xb of the light-receiving device 62.

According to the present (sixth) embodiment as explained above, each leg 70 can rotate such that, based on its location in the rotational direction of the rotary body 51, the time during which the detection light, which is emitted from the light-emitting surface 63 as the rotary body 51 is rotating, is blocked by the leg 70 can be advantageously decreased. In addition, each leg 70 can rotate such that, based on its location in the rotational direction of the rotary body 51, the time during which the detection light, which is reflected by one or more objects as the rotary body 51 is rotating, is blocked by the leg 70 can be advantageously decreased. In the present embodiment, too, a decrease in detection accuracy can be curtailed while increasing the strength or robustness of the legs 70.

Seventh Embodiment

A seventh embodiment will now be explained. In the explanation below, structural elements the same as or equivalent to those in the embodiment described above are assigned the same symbols, and explanations thereof are abbreviated or omitted.

Figure 24:
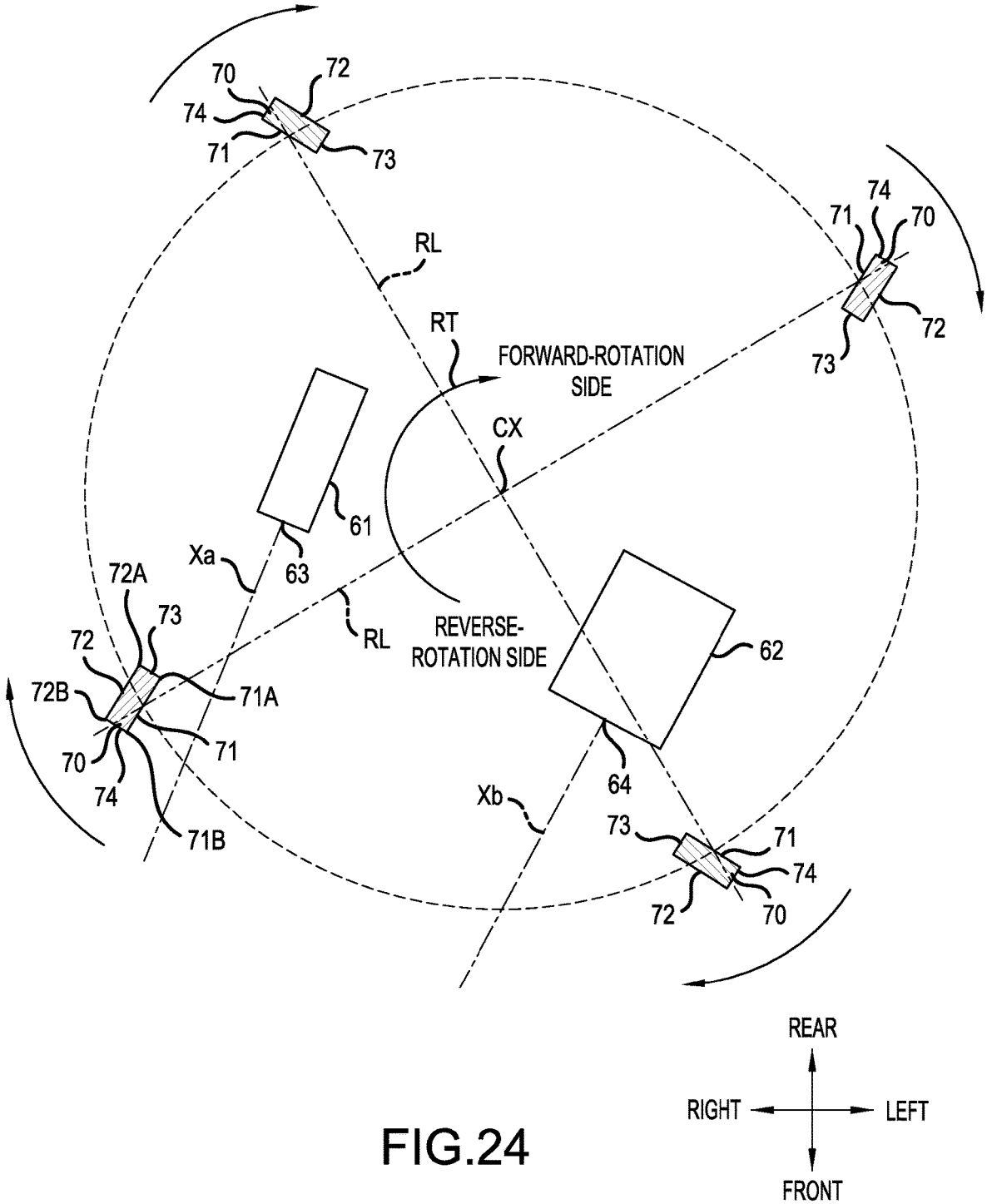
FIG. 24 is a cross-sectional view that schematically shows the light-emitting device, the light-receiving device, and the legs according to a seventh embodiment of the present teachings.

FIG. 24 is a cross-sectional view that schematically shows the light-emitting device 61, the light-receiving device 62, and the legs 70 according to the present (seventh) embodiment. As shown in FIG. 24, the legs 70 are capable of revolving around rotational axis CX. In the present embodiment, the cover 52 and the legs 70 are one body (i.e. integrally formed with no seam therebetween) and are adapted/configured to revolve (orbit) together about rotational axis CX. The cover 52 and the legs 70 are adapted/configured to revolve relative to the support member 53 and the coupling member 54.

In the present embodiment, the cover 52 and the legs 70 revolve such that the legs 70 are disposed in the optical path of the detection light emitted from the light-emitting device 61 and the optical path of the detection light that enters the light-receiving device 62. In the present embodiment, too, a decrease in detection accuracy can be curtailed while increasing the strength of the legs 70.

Eighth Embodiment

An eighth embodiment will now be explained. In the explanation below, structural elements the same as or equivalent to those in the embodiment described above are assigned the same symbols, and explanations thereof are abbreviated or omitted.

Figure 25:
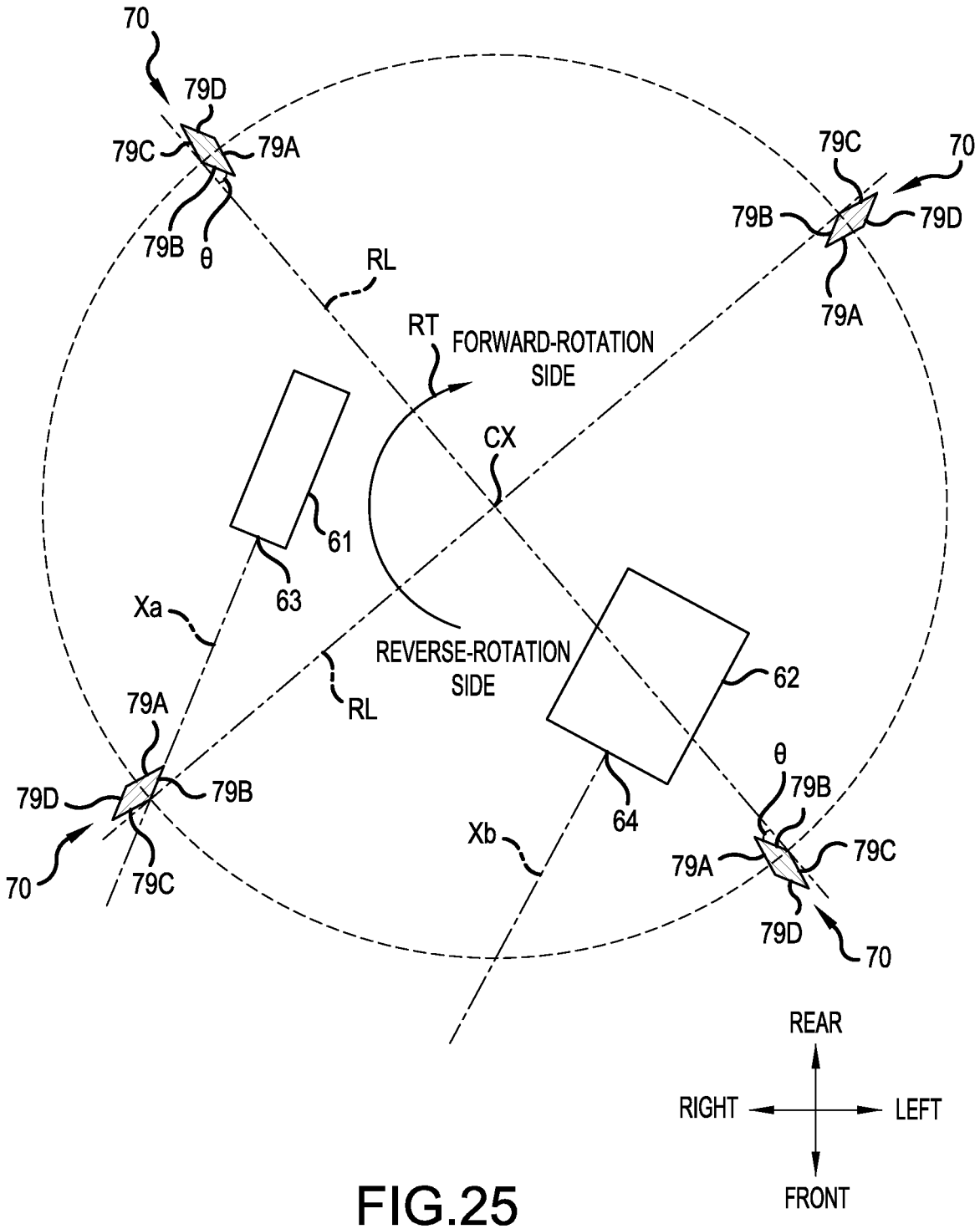
FIG. 25 is a cross-sectional view that schematically shows a light-emitting device, a light-receiving device, and the legs according to an eighth embodiment of the present teachings.
Figure 26:
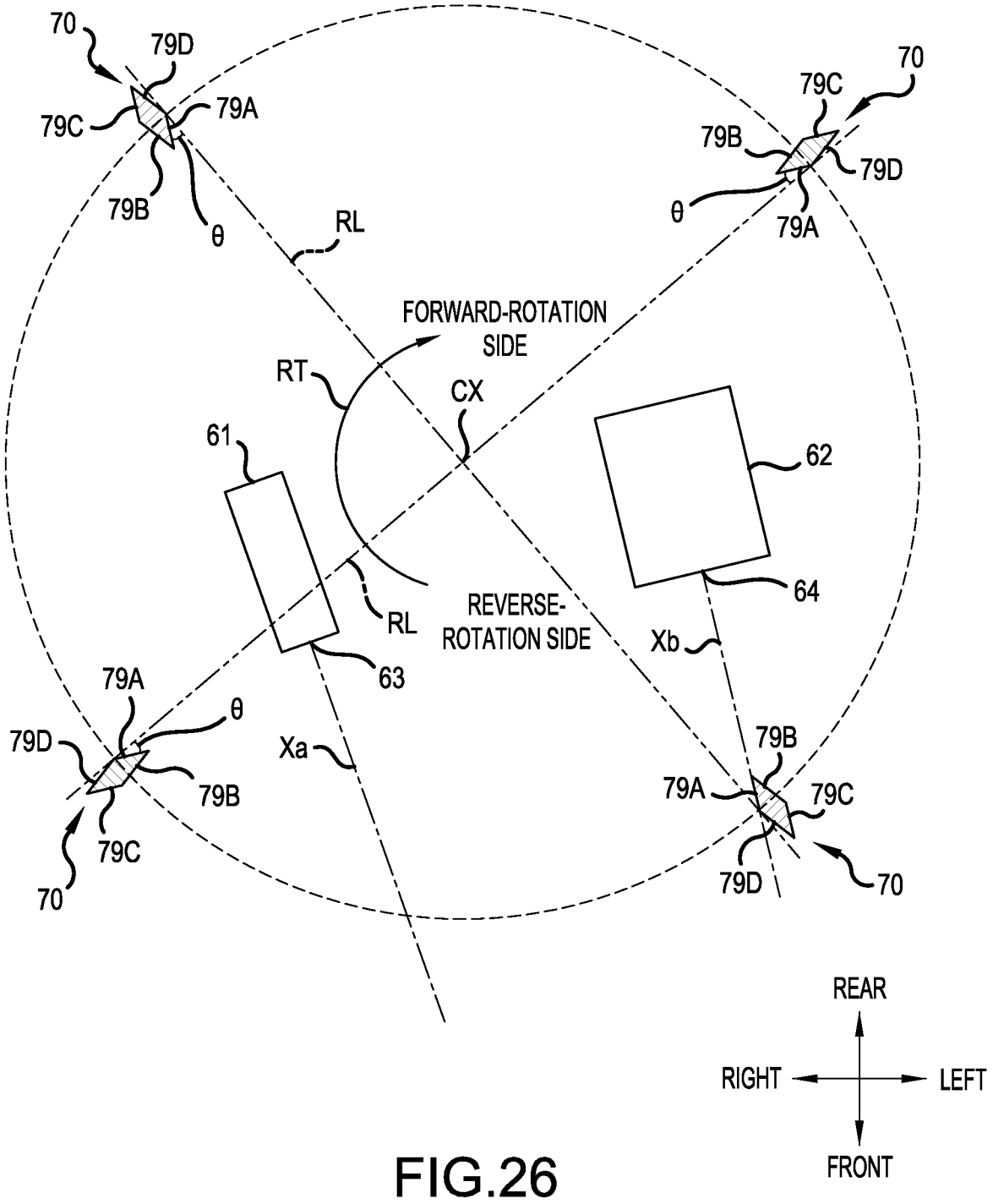
FIG. 26 is a cross-sectional view that schematically shows the light-emitting device, the light-receiving device, and the legs according to the eighth embodiment of the present teachings, in which the light-emitting and the light-receiving device have been rotated relative to the legs as compared to the view of FIG. 25.

FIGS. 25 and 26 are cross-sectional views that schematically show the light-emitting device 61, the light-receiving device 62, and modified legs 70 according to the present (eighth) embodiment. In the eighth embodiment, the legs 70 have a parallelogram shape in horizontal cross-section and thus the design of the legs 70 incorporates aspects of the above-described first and fifth embodiments.

More specifically, each of the legs 70 has a first pair of parallel sides (flat surfaces) 79B, 79D that will respectively coincide with the optical axis Xa at first and second rotational positions of the rotary body 51 relative to the legs 70. Thus, parallel sides 79B, 79D respectively correspond to (e.g., are oriented in the same way as) the first (flat) side surface 71 and the second (flat) side surface 72, which is parallel to the first side surface 71, of the first embodiment. The orientation (angle) of side 79B also corresponds to the orientation (angle) of side 75B of the fifth embodiment. In FIG. 25, the optical axis Xa coincides with side 79B.

Furthermore, each leg 70 of the eighth embodiment also has a second pair of parallel sides 79A, 79C that will respectively coincide with the optical axis Xb at third and fourth rotational positions of the rotary body 51 relative to the legs 70. Thus, side 79A corresponds to (e.g., is oriented in the same way as) the first (flat) side surface 71 of the first embodiment. The orientation (angle) of side 79A also corresponds to the orientation (angle) of side 75A of the fifth embodiment. In FIG. 26, the optical axis Xb coincides with side 79A.

Side 79C differs from the preceding embodiments because side 79C is arranged to coincide with optical axis Xb at the above-mentioned fourth rotational position of the rotary body 51 relative to the legs 70.

Although sides 79B, 79D preferably coincide with the optical axis Xa at first and second rotational positions, respectively, of the rotary body 51 relative to the legs 70, the sides 79B, 79D may be slightly oblique to the optical axis Xa when the optical axis Xa intersects the respective side 79B, 79D. For example, when the optical axis Xa intersects a middle point of side 79B, the optical axis Xa and side 79B may form an angle of 0-5°. Similarly, when the optical axis Xa intersects a middle point of side 79D, the optical axis Xa and side 79D may form an angle of 0-5°.

Likewise, although sides 79A, 79C preferably coincide with the optical axis Xb at third and fourth rotational positions, respectively, of the rotary body 51 relative to the legs 70, the sides 79A, 79C may be slightly oblique to the optical axis Xb when the optical axis Xb intersects the respective side 79A, 79D. For example, when the optical axis Xb intersects a middle point of side 79A, the optical axis Xb and side 79A may form an angle of 0-5°. Similarly, when the optical axis Xb intersects a middle point of side 79C, the optical axis Xb and side 79C may form an angle of 0-5°.

Effects

The first pair of parallel (flat) sides 79B, 79D provides the same advantages as sides 71, 72 of the first embodiment; namely, because sides 79B, 79D are parallel and respectively coincide with the optical axis Xa at the above-mentioned first and second rotational positions of the rotary body 51 relative to the legs 70, the profile (in particular, the width in the circumferential direction of the rotary body 51) of the legs 70 minimizes blocking of the light emitted from the light-emitting device 61 along optical axis Xa while the rotary body 51 is rotating relative to the legs 70.

The second pair of parallel (flat) sides 79A, 79C are designed to minimize the blocking of reflected light to the light-receiving device 62 along optical axis Xb while the rotary body 51 is rotating relative to the legs 70. That is, in the eight embodiment, reflected light is blocked only within a rotational range corresponding to the distance between the intersection of sides 79A, 79D and the intersection of sides 79B, 79C. Thus, the profile (in particular, the width in the circumferential direction of the rotary body 51) of the legs 70 with respect to the optical axis Xb is reduced as compared to the first and fifth embodiments.

Modifications

In FIGS. 25 and 26, the sides 79A-79D intersect each other to form corners or angles, whereby a parallelogram is formed. However, it is noted that the sides 79A-79D need not intersect to form angles (corners), but rather one or more of the sides 79A-79D may transition to its adjacent side 79A-79D along a curved or rounded path. In particular, the radially outermost corner (where sides 79C, 79D meet) may preferably be rounded to improve robustness and durability.

In FIGS. 25 and 26, the sides 79A-79D form a rhomboid, because the length of sides 79B, 79D is shorter than the length of sides 79A, 79C. Preferably, the length of sides 79B, 79D is 10-30% shorter than the length of sides 79A, 79C, more preferably 15-25% shorter. However, in alternate embodiments of the present teachings, the sides 79A-79D may form a rhombus, in which all four sides 79A-79D have equal lengths, or even the length of sides 79B, 79D may be longer than the length of sides 79A, 79C, e.g., 10-30% longer, more preferably 15-25% longer.

In other exemplary embodiments of the present teachings, the legs 70 may be designed as quadrilaterals in horizontal cross section, such that the quadrilaterals have a major or longer diagonal that coincides with a radial extension from the rotational axis CX. The minor or shorter diagonal of the quadrilateral intersects the major diagonal and is shorter in length than the major diagonal. The minor diagonal need not be perpendicular to the major diagonal and may form a largest angle with the major diagonal in the range of 95–130°, 100-120°, e.g., 105-115°.

Furthermore, although the legs 70 of the eighth embodiment have two pairs of parallel sides, the legs 70 may have other quadrilateral cross-sections that have only one pair of (precisely parallel) sides (e.g., a trapezoid shape) or no pair of (precisely parallel) sides. One two, three or four of the corners of such a quadrilateral also may be rounded or curved instead of angled.

Thus, the autonomous cleaning device 1 of the eighth embodiment, which may optionally be a robotic vacuum has an optical sensor 50 that comprises: a rotary body 51 adapted/configured to rotate relative to a main body 2 about a rotational axis CX; a light-emitting device 61 provided on (e.g., affixed to) the rotary body 51; a light-receiving device 62 provided on (e.g., affixed to) the rotary body 51; a cover 52 disposed upward of the rotary body 51; and legs 70 disposed around the rotary body 51 and supporting the cover 52 with respect to the main body 2. In a cross section orthogonal to the rotational axis CX, the legs 70 have an at least substantially quadrilateral shape. Preferably, at a first rotational position of the rotary body 51 relative to the legs 70, an optical axis Xa of the light-emitting device 61 coincides, or forms an angle less than 5°, with a first surface 79B of one of the legs 70. At a second rotational position of the rotary body 51 relative to the legs 70, the optical axis Xa of the light-emitting device 61 coincides, or forms an angle less than 5°, with a second surface 79D of the one of the legs 70. At a third rotational position of the rotary body 51 relative to the legs 70, an optical axis Xb of the light-receiving device 62 coincides, or forms an angle less than 5°, with a third surface 79A of the one of the legs 70. At a fourth rotational position of the rotary body 51 relative to the legs 70, the optical axis Xb of the light-receiving device 62 coincides, or forms an angle less than 5°, with a fourth surface 79C of the one of the legs 70.

The at least substantially quadrilateral shape is preferably a parallelogram shape, more preferably a rhomboid shape, although it may be a rhombus shape.

One or more of the corners of the at least substantially quadrilateral shape is angled, e.g., at least two corners are angled, at least three corners are angled or all four corners are angled. In addition or in the alternative, one or more of the corners of the at least substantially quadrilateral shape is curved, e.g., at least two corners are curved, at least three corners are curved or all four corners are curved.

Although the above-described embodiments primarily concern a robotic vacuum (i.e. having a suctioning capability), the present teachings are equally applicable any kind of autonomous cleaning device, such as including autonomous mopping robots, autonomous floor scrubbers, autonomous UV sterilizers, etc., or any kind of device that performs robotic mapping.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved robotic vacuums and autonomous cleaning devices and methods of using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Although some aspects of the present disclosure have been described in the context of a device, it is to be understood that these aspects also represent a description of a corresponding method, so that each block, part or component of a device, such as the controller 100, is also understood as a corresponding method step or as a feature of a method step. In an analogous manner, aspects which have been described in the context of or as a method step also represent a description of a corresponding block or detail or feature of a corresponding device, such as the controller 100.

Depending on certain implementation requirements, exemplary embodiments of the controller 100 of the present disclosure may be implemented in hardware and/or in software. The implementation can be configured using a digital storage medium, for example one or more of a ROM, a PROM, an EPROM, an EEPROM or a flash memory, on which electronically readable control signals (program code) are stored, which interact or can interact with a programmable hardware component such that the respective method is performed.

Optical sensors (50) according to the present teachings may be adapted/configured to simply collect and output data concerning objects in the surroundings of the optical sensor, such that the outputted data is analyzed by a controller, e.g., of the robotic vacuum and autonomous cleaning device. In the alternative, the controller for analyzing the data collected by the optical sensor may be integrated in the optical sensor, such that the optical sensor is fully capable of generating map and location data that may be output for use with or by another device.

A programmable hardware component can be formed by a processor, a computer processor (CPU=central processing unit), an application-specific integrated circuit (ASIC), an integrated circuit (IC), a computer, a system-on-a-chip (SOC), a programmable logic element, or a field programmable gate array (FGPA) including a microprocessor.

The digital storage medium can therefore be machine- or computer readable. Some exemplary embodiments thus comprise a data carrier or non-transient computer readable medium which includes electronically readable control signals that are capable of interacting with a programmable computer system or a programmable hardware component such that one of the methods described herein is performed. An exemplary embodiment is thus a data carrier (or a digital storage medium or a non-transient computer-readable medium) on which the program for performing one of the methods described herein is recorded.

In general, exemplary embodiments of the present disclosure, in particular the controller 100, are implemented as a program, firmware, computer program, or computer program product including a program, or as data, wherein the program code or the data is operative to perform one of the methods when the program is executed by a processor or a programmable hardware component. The program code or the data can for example also be stored on a machine-readable carrier or data carrier. The program code or the data can be, among other things, source code, machine code, bytecode or another intermediate code.

A program according to an exemplary embodiment can implement one of the methods during its performing, for example, such that the program reads storage locations or writes one or more data elements into these storage locations, wherein switching operations or other operations are induced in transistor structures, in amplifier structures, or in other electrical, optical, magnetic components, or components based on another functional principle. Correspondingly, data, values, sensor values, or other program information can be captured, determined, or measured by reading a storage location. By reading one or more storage locations, a program can therefore capture, determine or measure sizes, values, variable, and other information, as well as cause, induce, or perform an action by writing in one or more storage locations, as well as control other apparatuses, machines, and components, and thus for example also perform complex processes using the device 1.

Therefore, although some aspects of the controller 100 may have been identified as "parts" or "units" or "steps", it is understood that such parts or units or steps need not be physically separate or distinct electrical components, but rather may be different blocks of program code that are executed by the same hardware component, e.g., one or more microprocessors.

Additional aspects of the present teachings include, but are not limited to:

1. An optical sensor (50) comprising:

a rotary body (51) adapted to rotate about a rotational axis (CX);

a light-emitting device (61) provided on the rotary body (51);

a light-receiving device (62) provided on the rotary body (51);

a cover (52) disposed upward of the rotary body (51); and legs (70) disposed around the rotary body (51) and supporting the cover (52);

wherein in a cross section orthogonal to the rotational axis (CX), at least a portion of a surface of each of the legs is inclined with respect to a virtual radial line (RL) extending in a radial direction of the rotational axis.

2. An optical sensor (50) according to the above Aspect 1, wherein:

each of the legs include a first side surface (71) and a second side surface (72), which is parallel to the first side surface (71); and the first side surface (71) and the second side surface (71) are each inclined with respect to the virtual radial line (RL).

3. The optical sensor (50) according to the above Aspect 2, wherein the first side surface (71) forms an inclination angle of with respect to the virtual radial line (RL) that is from 5° to 85°.

4. The optical sensor (5) according to the above Aspect 2 or 3, wherein:

an optical axis (Xa) of the light-emitting device (61) is inclined with respect to the virtual radial line (RL); and at least one of the first side surface (71) and the second side surface (72) is inclined such that it is parallel to, or coincides with, the optical axis (Xa) when at least a portion of one of the legs (70) faces a light-emitting surface (63) of the light-emitting device (61).

5. The optical sensor according to any one of the above Aspects 2-4, wherein:

an optical axis (Xb) of the light-receiving device (62) is inclined with respect to the virtual radial line (RL); and at least one of the first side surface (71) and the second side surface (72) is inclined such that it is parallel to, or coincides with, the optical axis (Xb) when at least a portion of one of the legs (70) faces a light-receiving surface (64) of the light-receiving device (62).

6. The optical sensor (50) according to the above Aspect 1, wherein:

each of the legs (70) include an inner-end area (75), which includes an inner-end part (70S) in the radial direction of the rotational axis (CX); and the inner-end area (75) has at least one surface (75A, 75B) that is inclined with respect to the virtual radial line (RL).

7. The optical sensor (50) according to the above Aspect 6, wherein:

an optical axis (Xa) of the light-emitting device (61) is inclined with respect to the virtual radial line (RL); and the at least one surface (75A) of the inner-end area (75) is inclined such that it is parallel to, or coincides with, the optical axis (Xa) when at least a portion of at least one of the legs (70) faces a light-emitting surface (62) of the light-emitting device (61).

8. The optical sensor (50) according to the above Aspect 6, wherein:

an optical axis (Xb) of the light-receiving device (62) is inclined with respect to the virtual radial line (RL); and the at least one surface (75B) of the inner-end area (75) is inclined such that it is parallel to, or coincides with, the optical axis (Xb) when at least a portion of at least one of the legs (70) faces a light-receiving surface (64) of the light-receiving device (62).

9. The optical sensor (50) according to the above Aspect 7 or 8, wherein:

each of the leg include an outer-end area (76) having an outer-end part (70T) in the radial direction of the rotational axis (CX); and the outer-end area (76) is at least partially inclined in the opposite direction to that of the inner-end area (75) with respect to the virtual radial line (RL).

10. The optical sensor (50) according to the above Aspect 6, wherein:

an optical axis (Xa) of the light-emitting device (61) is inclined with respect to the virtual radial line (RL);

an optical axis (Xb) of the light-receiving device (62) is inclined with respect to the virtual radial line (RL); and the inner-end area (75) includes: a first inner-end area (75A), which is inclined such that it is parallel to, or coincides with, the optical axis (Xa) of the light-emitting device (61) when at least a portion of at least one of the legs (70) faces a light-emitting surface (63) of the light-emitting device (61); and a second inner-end area (75B), which is inclined such that it is parallel to, or coincides with, the optical axis (Xb) of the light-receiving device (62) when at least a portion of at least one of the legs (70) faces a light-receiving surface (64) of the light-receiving device (62).

11. The optical sensor (50) according to the above Aspect 10, wherein:

each of the legs (70) includes an outer-end area (76) having an outer-end part (70T) in the radial direction of the rotational axis (CX); and the outer-end area (76) includes: a first outer-end area (76A), which is connected to the first inner-end area (75A) and is at least partially inclined in the opposite direction to that of the first inner-end area (75A) with respect to the virtual radial line (RL); and a second outer-end area (76B), which is connected to the second inner-end area (75B) and is at least partially inclined in the opposite direction to that of the second inner-end area (75B) with respect to the virtual radial line (RL).

12. An optical sensor (50) comprising:

a rotary body (51) adapted to rotate about a rotational axis (CX);

a light-emitting device (61) affixed to the rotary body (51) at a first position spaced apart from the rotational axis (CX), the light-emitting device (61) being adapted to emit light along a first optical axis (Xa) that is oblique to a radial direction (RL) of the rotational axis (CX);

a light-receiving device (62) affixed to the rotary body (51) at a second position spaced apart from the rotational axis (CX), the light-receiving device (61) being adapted to receive light reflected from an object in the surroundings of the optical sensor (50) at least along a second optical axis (Xb) that is oblique to a radial direction (RL) of the rotational axis (CX);

a cover (52) disposed upward of the rotary body (51); and at least first and second legs (70) disposed around the rotary body (51) and supporting the cover (52);

wherein the rotary body (51), the light-emitting device (61) and the light-receiving device (62) are rotatable relative to the first and second legs (70) such that the first optical axis (Xa) and the second optical axis (Xb) periodically intersect each of the first and second legs (70) while the rotary body (51) is rotating relative to the legs (70);

the first leg (70) has a flat surface (71; 75A) that coincides with the first optical axis (Xa) at a first rotational position of the rotary body (51) relative to the legs (70); and the second leg (70) has a flat surface (71; 75A) that coincides with the first optical axis (Xa) at a second rotational position of the rotary body (51) relative to the legs (70) that differs from the first rotational position.

13. A robotic vacuum (1) comprising:

at least one battery-mounting part (4), on which a battery (BT) is mounted; and the optical sensor (50) according to any one of the above Aspects 1-12.

14. The robotic vacuum (1) according to the above Aspect 13, further comprising:

a main body (2);

a substrate (53; 2A; 11A) disposed or defined on the main body (2) and supporting the legs (70), the rotary body (51) being rotatable relative to the substrate (53; 2A; 11A);

a suction port (15) defined in the main body (2);

one or more brushes (16, 18) rotatably mounted on the main body (2) and adapted to sweep dust, debris, etc. toward the suction port (15); and a fan unit (5) disposed within the main body (2) and adapted to suction dust, debris, etc. located in the vicinity of the suction port (15) into a dust box (6) located within the main body (2).

15. The robotic vacuum (1) according to the above Aspect 14, further comprising:

a traveling apparatus (12) having wheels (10) adapted to move the robotic vacuum (1) across a surface-to-be-cleaned (FL);

one or more sensors (41, 42, 43) disposed on the main body (2) and adapted to sense objects in the surroundings of the robotic vacuum (1); and a controller (100) disposed within the main body (2) and adapted to control rotation of the wheels (10) of the traveling apparatus (12) at least in part based upon signals from the optical sensor (50) and the one or more sensors (41, 42, 43).

EXPLANATION OF THE REFERENCE NUMBERS

1 Robotic vacuum
2 Main body
2A Upper surface
2B Bottom surface
2C Side surface
3 Bumper
4 Battery-mounting part
5 Fan unit
5A Casing
5B Suction fan
5C Suction motor
5D Air-suction port
5E Air-exhaust port
6 Dust box
7 Castor
8 Roller
9 Wheel
10 Wheel motor
11 Housing
11A Upper housing
11B Lower housing
11Bs Support shaft
11C Cover plate
11D Bottom plate
12 Travelling apparatus
15 Suction port
16 Main brush
16B Brush
16R Rod member
17 Main-brush motor
18 Side brush
18B Brush
18D Disk
18S Screw
19 Side-brush motor
20 Handle
30 User interface
30A Power-supply button
30B Remaining-battery-charge display part
41 Obstacle sensor
42 Cliff sensor
42B Cliff sensor
42F Cliff sensor
42L Cliff sensor
42R Cliff sensor
43 Boundary sensor
50 Optical sensor
51 Rotary body
51A Top-plate part
51B Side-plate part
51C Holding-plate part
51D First opening
51E Second opening
52 Cover
53 Support member
54 Coupling member
54A Opening
61 Light-emitting device
62 Light-receiving device
63 Light-emitting surface
64 Light-receiving surface
70 Leg
70A First leg
70B Second leg
70C Third leg
70S Inner-end part
70T Outer-end part
71 First side surface
71A Inner-end part
71B Outer-end part
72 Second side surface
72A Inner-end part
72B Outer-end part

73 Inner surface
74 Outer surface
75 Inner-end area
75A First inner-end area
75B Second inner-end area
75Sa Inner-end part
75Sb Inner-end part
75Ta Outer-end part
75Tb Outer-end part
76 Outer-end area
76A First outer-end area
76B Second outer-end area
76Sa Inner-end part
76Sb Inner-end part
76Ta Outer-end part
76Tb Outer-end part
77 Flat surface
78 Flat surface
79A-79D Flat surfaces
81 Rotary member
81A Hole
81B Hole
81C Hole
82 Shaft
83 Wheel
83A Hole
84 Pin
85 Recessed part
86 Stop ring
91 Rotary shaft
92 Bearing
93 Gear part
94 Gear housing
100 Controller
181 Inner-tube part
182 First outer-tube part
183 Second outer-tube part
AX Rotational axis
BX Rotational axis
CX Rotational axis
DX Rotational axis
EX Rotational axis
BT Battery
FL Surface-to-be-cleaned
RL Virtual line
RT Arrow
Xa Optical axis
Xb Optical axis

The invention claimed is:

1. An autonomous cleaning device having an optical sensor that comprises:

a rotary body configured to rotate relative to a main body about a rotational axis;

a light-emitting device provided on the rotary body;

a light-receiving device provided on the rotary body;

a cover disposed upward of the rotary body; and legs disposed around the rotary body and supporting the cover with respect to the main body;

wherein:

in a cross section orthogonal to the rotational axis (CX), at least a portion of a surface of each of the legs is inclined with respect to a virtual radial line (RL) extending in a radial direction of the rotational axis;

each of the legs includes a first side surface and a second side surface, which is parallel to the first side surface;

the first side surface and the second side surface are each inclined with respect to the virtual radial line (RL);

an optical axis (Xa) of the light-emitting device is inclined with respect to the virtual radial line; and at least one of the first side surface and the second side surface is inclined such that it is parallel to, or coincides with, the optical axis (Xa) when at least a portion of one of the legs faces a light-emitting surface of the light-emitting device.

2. The autonomous cleaning device according to claim 1, wherein the first side surface forms an inclination angle with respect to the virtual radial line that is from 5° to 85°.

3. The autonomous cleaning device according to claim 1, wherein:

an optical axis (Xb) of the light-receiving device is inclined with respect to the virtual radial line (RL); and at least one of the first side surface and the second side surface is inclined such that it is parallel to, or coincides with, the optical axis (Xb) when at least a portion of one of the legs faces a light-receiving surface of the light-receiving device.

4. The autonomous cleaning device according to claim 1, further comprising:

at least one battery-mounting part provided on the main body and configured to mount a battery pack.

5. The autonomous cleaning device according to claim 4, further comprising:

a traveling apparatus having wheels configured to move the main body across a surface;

one or more sensors disposed on the main body and configured to sense objects in the surroundings of the main body; and a controller disposed within the main body and configured to control rotation of the wheels of the traveling apparatus at least in part based upon signals from the optical sensor and the one or more sensors.

6. The autonomous cleaning device according to claim 5, further comprising:

a substrate disposed or defined on the main body and supporting the legs, the rotary body being rotatable relative to the substrate;

a suction port defined in the main body;

one or more brushes rotatably mounted on the main body and configured to sweep dust, debris, etc. toward the suction port; and a fan unit disposed within the main body and configured to suction dust, debris, etc. located in the vicinity of the suction port into a dust box located within the main body.

7. An autonomous cleaning device having an optical sensor that comprises:

a rotary body configured to rotate relative to a main body about a rotational axis (CX);

a light-emitting device affixed to the rotary body at a first position spaced apart from the rotational axis (CX), the light-emitting device being configured to emit light along a first optical axis (Xa) that is oblique to a radial direction of the rotational axis;

a light sensor affixed to the rotary body at a second position spaced apart from the rotational axis (CX), the light sensor being configured to sense light reflected from an object in the surroundings of the optical sensor at least along a second optical axis (Xb) that is oblique to a radial direction (RL) of the rotational axis (CX);

a cover disposed upward of the rotary body; and at least first and second legs disposed around the rotary body and supporting the cover with respect to the main body;

wherein the rotary body, the light-emitting device and the light sensor are rotatable relative to the first and second legs such that the first optical axis (Xa) and the second optical axis (Xb) periodically intersect each of the first and second legs while the rotary body is rotating relative to the legs;

the first leg has a first flat surface that coincides with the first optical axis (Xa) at a first rotational position of the rotary body relative to the legs; and the second leg has a first flat surface that coincides with the first optical axis (Xa) at a second rotational position of the rotary body relative to the legs that differs from the first rotational position.

8. The autonomous cleaning device according to claim 7, wherein:

each of the first and second legs includes an inner-end area having an inner-end part in the radial direction of the rotational axis (CX);

the inner-end area of the first leg includes the first flat surface of the first leg;

the inner-end area of the second leg includes the first flat surface of the second leg; and each of the first flat surfaces is inclined with respect to the virtual radial line (RL).

9. The autonomous cleaning device according to claim 8, wherein:

the first flat surface of the inner-end area of each of the first and second legs is inclined such that it is parallel to, or coincides with, the optical axis (Xa) of the light-emitting device when at least a portion of at least one of the first and second legs faces a light-emitting surface of the light-emitting device.

10. The autonomous cleaning device according to claim 8, wherein:

a second flat surface of the inner-end area of each of the first and second legs is inclined such that it is parallel to, or coincides with, the second optical axis (Xb) when at least a portion of at least one of the first and second legs faces a light-receiving surface of the light sensor.

11. The autonomous cleaning device according to claim 10, wherein:

each of the first and second legs includes an outer-end area having an outer-end part in the radial direction of the rotational axis (CX); and the outer-end area is at least partially inclined in the opposite direction to that of the inner-end area with respect to the virtual radial line (RL).

12. The autonomous cleaning device according to claim 8, wherein:

the inner-end area includes:

a first inner-end area that is inclined such that it is parallel to, or coincides with, the first optical axis (Xa) of the light-emitting device when at least a portion of at least one of the first and second legs faces a light-emitting surface of the light-emitting device; and a second inner-end area that is inclined such that it is parallel to, or coincides with, the second optical axis (Xb) of the light sensor when at least a portion of at least one of the first and second legs faces a light-receiving surface of the light sensor.

13. The autonomous cleaning device according to claim 12, wherein:

each of the first and second legs includes an outer-end area having an outer-end part in the radial direction of the rotational axis (CX); and the outer-end area includes:

a first outer-end area that is connected to the first inner-end area and is at least partially inclined in the opposite direction to that of the first inner-end area with respect to the virtual radial line (RL); and a second outer-end area that is connected to the second inner-end area and is at least partially inclined in the opposite direction to that of the second inner-end area with respect to the virtual radial line.

14. The autonomous cleaning device according to claim 7, wherein the first and second legs each have a second flat surface that is parallel to the first flat surface.

15. The autonomous cleaning device according to claim 7, wherein:

the first leg has a second flat surface that coincides with the second optical axis (Xb) at a third rotational position of the rotary body relative to the legs; and the second leg has a second flat surface that coincides with the second optical axis (Xb) at a fourth rotational position of the rotary body relative to the legs that differs from the third rotational position.

16. The autonomous cleaning device according to claim 7, wherein the first and second flat surfaces of each of the first and second legs intersect and form an isosceles triangle in plan view.

17. The autonomous cleaning device according to claim 7, further comprising:

a battery-mounting part defined on the main body and configured to mount a rechargeable battery pack;

a traveling apparatus having wheels configured to move the main body across a surface;

one or more sensors disposed on the main body and configured to sense objects in the surroundings of the main body; and a controller disposed within the main body and configured to control rotation of the wheels of the traveling apparatus at least in part based upon signals from the optical sensor and the one or more sensors.

18. The autonomous cleaning device according to claim 17, further comprising:

a substrate disposed or defined on the main body and supporting the legs, the rotary body being rotatable relative to the substrate;

a suction port defined in the main body;

one or more brushes rotatably mounted on the main body and configured to sweep dust, debris, etc. toward the suction port; and a fan unit disposed within the main body and configured to suction dust, debris, etc. located in the vicinity of the suction port into a dust box located within the main body.

19. An autonomous cleaning device having an optical sensor that comprises:

a rotary body configured to rotate relative to a main body about a rotational axis;

a light-emitting device provided on the rotary body;

a light-receiving device provided on the rotary body;

a cover disposed upward of the rotary body; and legs disposed around the rotary body and supporting the cover with respect to the main body;

wherein:

in a cross section orthogonal to the rotational axis (CX), at least a portion of a surface of each of the legs is inclined with respect to a virtual radial line (RL) extending in a radial direction of the rotational axis;

each of the legs includes a first side surface and a second side surface, which is parallel to the first side surface;

the first side surface and the second side surface are each inclined with respect to the virtual radial line (RL);

an optical axis (Xb) of the light-receiving device is inclined with respect to the virtual radial line (RL); and at least one of the first side surface and the second side surface is inclined such that it is parallel to, or coincides with, the optical axis (Xb) when at least a portion of one of the legs faces a light-receiving surface of the light-receiving device.

20. The autonomous cleaning device according to claim 19, further comprising:

at least one battery-mounting part provided on the main body and configured to mount a battery pack;

a traveling apparatus having wheels configured to move the main body across a surface;

one or more sensors disposed on the main body and configured to sense objects in the surroundings of the main body; and a controller disposed within the main body and configured to control rotation of the wheels of the traveling apparatus at least in part based upon signals from the optical sensor and the one or more sensors.

* * * * *